US008673523B2

(12) United States Patent
Hirose et al.

(10) Patent No.: US 8,673,523 B2
(45) **Date of Patent: *Mar. 18, 2014**

(54) IMAGE HOLDING MEMBER FOR IMAGE FORMING APPARATUS, PROCESS CARTRIDGE, AND IMAGE FORMING APPARATUS

(75) Inventors: Hidekazu Hirose, Kanagawa (JP); Takeshi Agata, Kanagawa (JP); Katsuhiro Sato, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 398 days.

This patent is subject to a terminal disclaimer.

(21) Appl. No.: 12/877,603

(22) Filed: Sep. 8, 2010

(65) Prior Publication Data

US 2011/0207040 A1 Aug. 25, 2011

(30) Foreign Application Priority Data

Feb. 19, 2010 (JP) ..... 2010-035394

(51) Int. Cl.
*G03G 5/06* (2006.01)
*G03G 5/047* (2006.01)

(52) U.S. Cl.
USPC ..... 430/58.5; 430/77; 430/58.7; 430/96; 399/111; 399/159

(58) Field of Classification Search
USPC ..... 430/77, 58.5, 96, 58.7; 399/159, 111
See application file for complete search history.

(56) References Cited

U.S. PATENT DOCUMENTS

| | | | | |
|---|---|---|---|---|
| 3,461,165 | A | 8/1969 | Frye | |
| 4,047,948 | A | 9/1977 | Horgan | |
| 4,299,897 | A | 11/1981 | Stolka et al. | |
| 5,134,049 | A * | 7/1992 | Kuroda et al. | 430/58.15 |
| 5,283,145 | A | 2/1994 | Nukada et al. | |
| 5,290,928 | A | 3/1994 | Nukada et al. | |
| 5,298,617 | A | 3/1994 | Nukada et al. | |
| 5,302,479 | A | 4/1994 | Daimon et al. | |
| 5,308,728 | A | 5/1994 | Imai et al. | |
| 5,338,636 | A | 8/1994 | Nukada et al. | |
| 5,358,813 | A | 10/1994 | Iijima et al. | |
| 5,378,569 | A | 1/1995 | Nukada et al. | |
| 5,393,629 | A | 2/1995 | Nukada et al. | |
| 5,416,207 | A | 5/1995 | Imai et al. | |
| 5,459,004 | A | 10/1995 | Daimon et al. | |
| 5,463,043 | A | 10/1995 | Nukada et al. | |
| 5,639,581 | A | 6/1997 | Iwasaki et al. | |
| 5,654,119 | A | 8/1997 | Ishii et al. | |
| 5,734,003 | A | 3/1998 | Iwasaki et al. | |
| 6,586,148 | B1 * | 7/2003 | Graham et al. | 430/58.65 |
| 7,812,172 | B2 * | 10/2010 | Horiba et al. | 548/153 |
| 2004/0086796 | A1 * | 5/2004 | Yu et al. | 430/58.15 |
| 2008/0008952 | A1 * | 1/2008 | Lim | 430/59.5 |
| 2011/0086999 | A1 * | 4/2011 | Hirose et al. | 528/289 |

FOREIGN PATENT DOCUMENTS

| | | | | |
|---|---|---|---|---|
| JP | A-47-30330 | | 11/1972 | |
| JP | A-61-132955 | | 6/1986 | |
| JP | 62196666 | A * | 8/1987 | G03G 5/06 |
| JP | A-62-267749 | | 11/1987 | |
| JP | 63280255 | A * | 11/1988 | G03G 5/06 |
| JP | A-3-138654 | | 6/1991 | |
| JP | A-4-189873 | | 7/1992 | |
| JP | A-5-43813 | | 2/1993 | |
| JP | A-5-98181 | | 4/1993 | |
| JP | A-5-140472 | | 6/1993 | |
| JP | A-5-140473 | | 6/1993 | |
| JP | A-5-263007 | | 10/1993 | |
| JP | A-5-279591 | | 10/1993 | |
| JP | A-8-176293 | | 7/1996 | |
| JP | A-8-208820 | | 8/1996 | |
| JP | 2009224662 | A * | 10/2009 | |

OTHER PUBLICATIONS

"Jikken Kagaku Koza," *The Fourth Series of Experimental Chemistry*, 1992, pp. 208-231, vol. 28.

U.S. Appl. No. 13/024,914, filed Feb. 10, 2011, in the name of Hidekazu Hirose et al.
Pang, H. et al., "Advantageous 3D Ordering of π-Conjugated Systems: A New Approach Towards Efficient Charge Transport in any Direction," Advanced Materials, 2007, pp. 4438-4442, vol. 19.

* cited by examiner

*Primary Examiner* — Christopher Rodee
(74) *Attorney, Agent, or Firm* — Oliff PLC

(57) ABSTRACT

An image holding member for an image forming apparatus includes: a substrate; and a photosensitive layer on the substrate, the photosensitive layer containing a compound including a partial structure represented by the following Formula (II-2)

Formula (II-2)

-continued wherein in Formula (II-2), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and n's each independently represent an integer of from 0 to 7.

20 Claims, 5 Drawing Sheets

IMAGE HOLDING MEMBER FOR IMAGE FORMING APPARATUS, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-035394 filed Feb. 19, 2010.

BACKGROUND

1. Technical Field

The present invention relates to an image holding member for an image forming apparatus, a process cartridge, and an image forming apparatus.

2. Related Art

A photoreceptor having a photosensitive layer containing an organic photoconductive compound as a main component has many advantages such as relatively easy production, low cost, good handleability, and excellent thermal stability, compared with a conventionally used photoreceptor containing an inorganic photoconductor (such as selenium, zinc oxide, cadmium sulfide, or silicon) as a main component, and thus has been studied vigorously.

Particularly, a photoreceptor have already been in practical use, which includes a multilayer function-separated photosensitive layer in which a charge generation function and a charge transport function of a photoconductor are assigned to separate functional layers, a material having the former charge generation function is contained in a charge generation layer, and a material having the latter charge transport function is contained in a charge transport layer.

SUMMARY

According to an aspect of the invention, there is provided an image holding member for an image forming apparatus, including:

a substrate; and a photosensitive layer on the substrate, the photosensitive layer containing a compound represented by the following Formula (I) or a compound represented by the following Formula (II-1)

Formula (I)

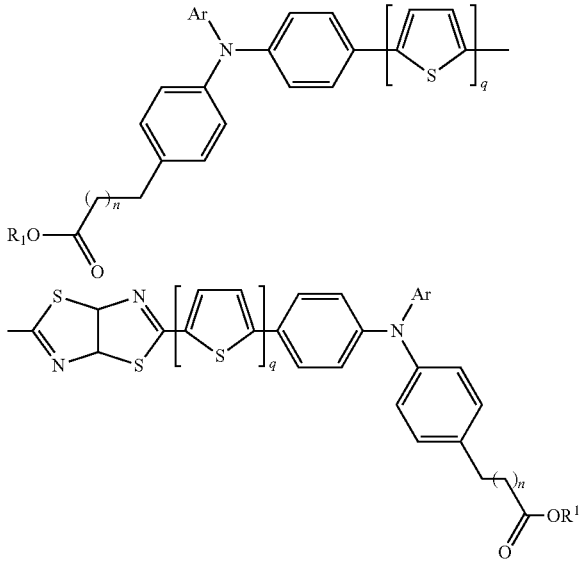

wherein in Formula (I), $R^1$'s each independently represent a substituted or unsubstituted, linear or branched alkyl group having from 1 to 8 carbon atoms; Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and n's each independently represent an integer of from 0 to 7

Formula (II-1)

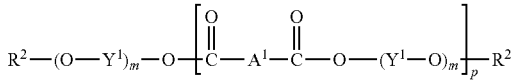

wherein in Formula (II-1), $Y^1$'s each independently represent a substituted or unsubstituted bivalent hydrocarbon group; $A^1$ represents a group represented by the following Formula (II-2); $R^2$'s each independently represent a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, a monovalent linear hydrocarbon group having from 1 to 6 carbon atoms, a monovalent branched hydrocarbon group having from 2 to 10 carbon atoms, or a hydrogen atom; m's each independently represent an integer of from 1 to 5; and p represents an integer of from 5 to 5,000

Formula (II-2)

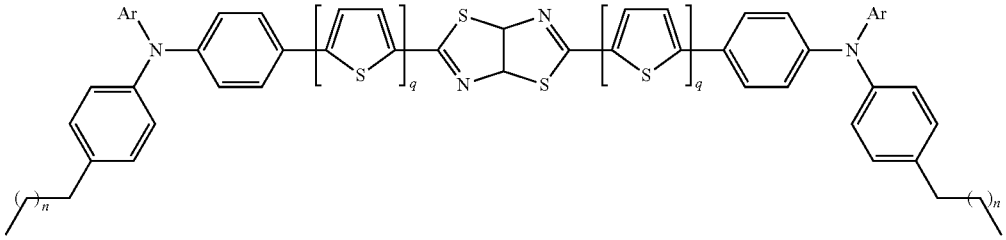

wherein in Formula (II-2), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and n's each independently represent an integer of from 0 to 7.

BRIEF DESCRIPTION OF THE DRAWINGS

Exemplary embodiments of the present invention will be described in detail based on the following figures, wherein.

DETAILED DESCRIPTION

Figure 1:
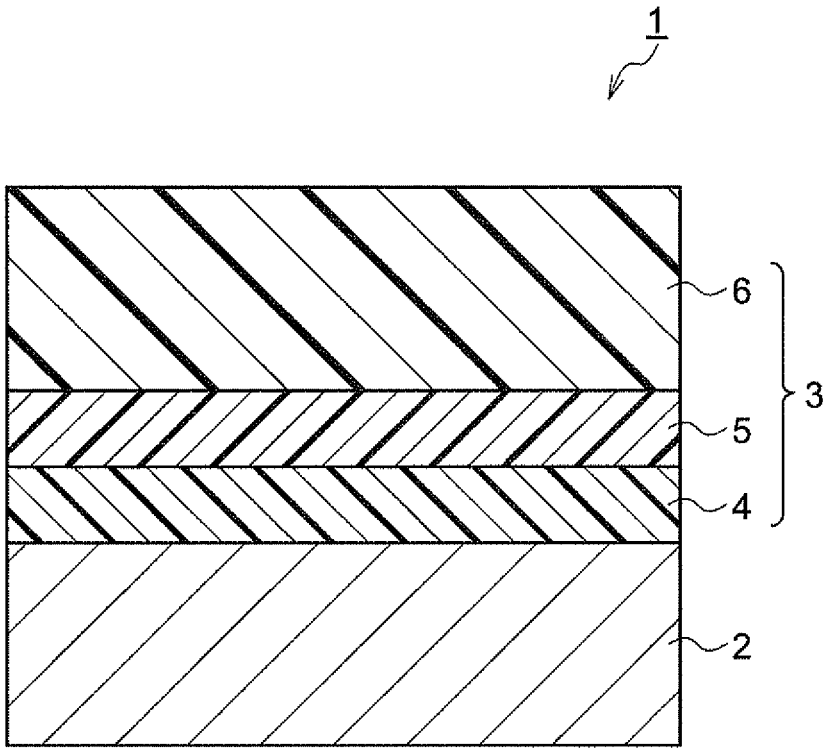
FIG. 1 is a schematic sectional view of an image holding member for an image forming apparatus according to a first exemplary embodiment of the invention.

Hereinafter, exemplary embodiments of the invention will be described.

In an exemplary embodiment of the invention, an image holding member for an image forming apparatus is provided in which at least one of a compound represented by Formula (I) or a compound represented by Formula (II-1) is used as a charge transport material. That is, in an image holding member for an image forming apparatus in which a photosensitive layer is formed on a substrate (for example, a conductive substrate), the photosensitive layer contains at least one of a compound represented by Formula (I) or a compound represented by Formula (II-1).

The conductive substrate in the exemplary embodiment means a substrate which is formed of a conductive material with a volume resistivity less than $10^7$ Ωcm which is measured on the basis of "Resistivity Test of Conductive Plastic using a Four Probe Method" of JIS K 7194, or a substrate in which a conductive layer formed of the conductive material is disposed on the surface of a substrate.

The photosensitive layer in the image holding member for an image forming apparatus may be any one of a single-layered photosensitive layer containing a charge generation material and a charge transport material in the same layer or a function-separated photosensitive layer in which a layer containing a charge generation material and a layer containing a charge transport material are separately but adjacently provided, wherein at least one of the compound represented by Formula (I) or the compound represented by Formula (II-1) is contained as a charge transport material.

Known charge generation materials such as oxytitanium phthalocyanine, chlorogallium phthalocyanine, or hydroxy gallium phthalocyanine may be used as the charge generation material. The image holding member for an image forming apparatus may have an overcoat layer on the uppermost surface (at a position farthest from the conductive substrate). In this case, the overcoat layer may contain cross-linked silicone resin having a charge transport property.

(Image Holding Member for Image Forming Apparatus)

The image holding member for an image forming apparatus according to the exemplary embodiment is an image holding member for an image forming apparatus in which a photosensitive layer containing at least one of the compound represented by Formula (I) or the compound represented by Formula (II-1) is formed on a substrate.

<Compound Represented by Formula (I)>

The compound represented by Formula (I) will be described below in detail.

Formula (I)

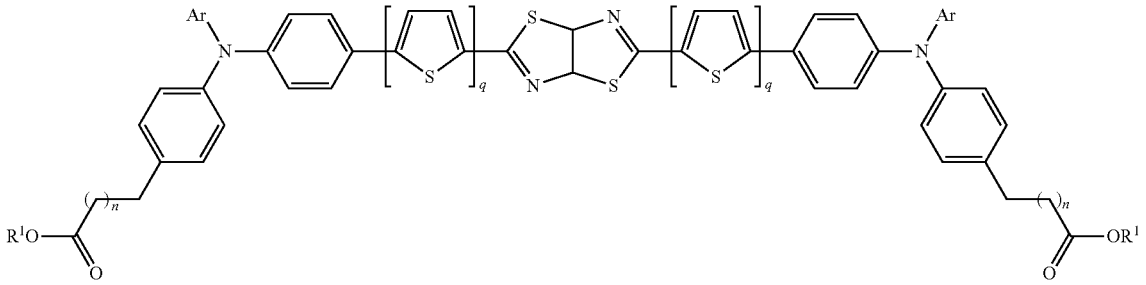

In Formula (I), $R^1$'s each independently represent a substituted or unsubstituted, linear or branched alkyl group having from 1 to 8 carbon atoms, Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group, q represents 0 or 1, and n's each independently represent an integer of from 0 to 7.

$R^1$ in Formula (I) will be described.

As described above, $R^1$'s in Formula (I) each independently represent a substituted or unsubstituted, linear or branched alkyl group having from 1 to 8 carbon atoms.

The alkyl group represented by $R^1$ may have from 1 to 6 carbon atoms or from 1 to 4 carbon atoms.

The alkyl group represented by $R^1$ has a linear shape or a branched shape and may be a linear alkyl group in view of the retention of crystallinity and the solubility.

In Formula (I), when the alkyl group represented by $R^1$ has a substituent group, examples of the substituent group include an aryl group and a heterocycle.

The aryl group as the substituent group may have from 6 to 20 carbon atoms and examples thereof include a phenyl group, a toluyl group, and a naphthyl group.

The heterocycle as the substituent group means a ring containing an element other than carbon and hydrogen. The number of atoms (Nr) of a cyclic skeleton of the heterocycle may be 5 or 6. The kind and the number of atoms (hetero atoms) other than carbon atoms constituting the cyclic skeleton is not particularly limited, but examples thereof include a sulfur atom, a nitrogen atom, an oxygen atom, a selenium atom, a silicon atom, and a phosphorus atom. The cyclic skeleton may contain two or more kinds of hetero atoms or two or more hetero atoms.

Examples of a five-membered heterocycle include thiophene, pyrrole, furan, imidazole, oxazole, selenophene, thiazole, thiadiazole, pyrazole, isooxazole, isothiazole, silole, and heterocycles obtained by substituting the carbon atoms at the 3- and 4-positions of the above compounds with nitrogen atoms. Examples of an aromatic heterocycle having a five-membered heterocycle include benzothiophene, benzimidazole, and indole.

Examples of a six-membered heterocycle include pyridine, pyrimidine, pyrazine, and piperazine.

In the heterocycle as the substituent group, the heterocycle may be substituted with an aromatic ring or an aromatic ring may be substituted with a heterocycle.

Examples of the alkyl group represented by $R^1$ in Formula (I) include a methyl group, an ethyl group, a propyl group, a n-butyl group, a t-butyl group, a n-hexyl group, and a n-octyl group. Among these, a methyl group, an ethyl group, a propyl group, a n-butyl group, a t-butyl group, a n-hexyl group, and a n-octyl group may be used, a methyl group and a butyl group may be used, or a methyl group or a butyl group may be used in view of easy production and the retention of crystallinity, and a methyl group may be used in view of easy availability.

$R^1$ represents a substituted or unsubstituted, linear or branched alkyl group having from 1 to 8 carbon atoms. Within this range, the variation in kind of the alkyl group hardly affects the ionization potential or the charge transport property.

Ar in Formula (I) will be described.

In Formula (I), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group.

Here, the "polynuclear aromatic hydrocarbon" means a hydrocarbon in which two or more aromatic rings including carbon and hydrogen exist and the rings are bonded by a carbon-carbon bond. Specifically, examples thereof include a hydrocarbon in which carbon atoms of separate aromatic rings are directly bonded to each other by a carbon-carbon bond and a hydrocarbon in which aromatic rings are bonded to each other by a carbon chain (an alkyl chain or an alkylene chain) having from 1 to 18 carbon atoms.

Examples of the polynuclear aromatic hydrocarbon include biphenyl, terphenyl, stilbene, and triphenyl ethylene. The "polynuclear aromatic hydrocarbon group" is a substituent group derived from a polynuclear aromatic hydrocarbon and examples thereof include a substituent group derived from biphenyl, that is, a biphenyl group.

The aromatic ring for constituting the polynuclear aromatic hydrocarbon group may be a condensed aromatic hydrocarbon or an aromatic heterocycle to be described later. Specific examples of the condensed aromatic hydrocarbon and the aromatic heterocycle for constituting the polynuclear aromatic hydrocarbon group include specific compounds to be described later.

The "condensed aromatic hydrocarbon" means hydrocarbon in which two or more aromatic rings including carbon and hydrogen exist and the aromatic rings share a pair of adjacently-bonded carbon atoms. Specific examples thereof include naphthalene, anthracene, phenanthrene, pyrene, perylene, and fluorene. The "condensed aromatic hydrocarbon group" is a substituent group derived from a condensed aromatic hydrocarbon and examples thereof include a substituent group derived from naphthalene, that is, a naphthyl group.

The "aromatic heterocycle" means an aromatic ring also including an atom other than carbon and hydrogen. The aromatic heterocyclic group is a substituent group derived from an aromatic heterocycle.

The number of atoms (Nr) constituting the cyclic skeleton of the aromatic heterocycle may be, for example, Nr=5 or Nr=6. The kind and the number of atoms (hetero atoms) other than carbon atoms constituting the cyclic skeleton are not particularly limited. Examples of the kinds of hetero atoms include a sulfur atom, a nitrogen atom, and an oxygen atom. The cyclic skeleton of the aromatic heterocycle may include two or more hetero atoms or two or more kinds of hetero atoms.

Particularly, examples of a heterocycle having a cyclic skeleton of Nr=5 (that is, a five-membered cyclic structure) include thiophene, thiophin, pyrrole, furan, and heterocycles obtained by substituting the carbon atoms at the 3- and 4-positions of the above compounds with nitrogen atoms. Examples of a heterocycle having a cyclic skeleton of Nr=6 (that is, six-membered cyclic structure) include a pyridine ring.

In the "substituted or unsubstituted monovalent aromatic group", examples of the substituent group for substituting the aromatic group include a hydrogen atom, an alkyl group, an alkoxy group, a phenoxy group, an aryl group, an aralkyl group, a substituted amino group, and a halogen atom. Among these, the hydrogen atom, the alkyl group, and the alkoxy group may be used.

The alkyl group may have, for example, from 1 to 10 carbon atoms, and specific examples thereof include a methyl group, an ethyl group, a propyl group, and an isopropyl group.

The alkoxy group may have, for example, from 1 to 10 carbon atoms, and specific examples thereof include a methoxy group, an ethoxy group, a propoxy group, and an isopropoxy group.

The aryl group may have, for example, from 6 to 20 carbon atoms, and specific examples thereof include a phenyl group and a toluyl group.

The aralkyl group may have, for example, from 7 to 20 carbon atoms, and specific examples thereof include a benzyl group and a phenethyl group.

Examples of the substituent group of the substituted amino group include an alkyl group, an aryl group, and an aralkyl group, and specific examples of the alkyl group, the aryl group, and the aralkyl group are as described above. Specific examples of the substituted amino group include a diphenyl amino group.

As Ar in Formula (I), among the above, a substituted or unsubstituted phenyl group or a substituted or unsubstituted polynuclear aromatic hydrocarbon group may be used, or a substituted or unsubstituted phenyl group or a substituted or unsubstituted polynuclear aromatic hydrocarbon group not including a condensed aromatic hydrocarbon or an aromatic heterocycle may be used, or a substituted or unsubstituted phenyl group or a substituted or unsubstituted polynuclear aromatic hydrocarbon group in which carbon atoms of separate aromatic rings are directly bonded to each other by a carbon-carbon bond may be used.

The aromatic ring number of Ar in Formula (I) may be in the range of from 1 to 6 in view of compatibility with a resin, or may be in the range of from 1 to 3, or may be 1 or 2. That is, specific examples of Ar in Formula (I) include a substituted or unsubstituted phenyl group and a substituted or unsubstituted biphenyl group, and more specific examples thereof include an unsubstituted phenyl group and an unsubstituted biphenyl group.

In Formula (I), q and n will be described.

In Formula (I), q is 0 or 1, and q may be 1 in view of the charge transport property.

In Formula (I), n's each independently represent an integer of from 0 to 7. Two n's in Formula (I) may be equal to or different from each other, but they may be equal to each other in view of production. In Formula (I), n may be great in view of the compatibility with a resin and may be small in view of the charge transport property. That is, n in Formula (I) may be an integer of from 0 to 4 in view of both the compatibility with a resin and the charge transport property, or may be an integer of from 0 to 3, or may be 1.

Specific example compounds (1) to (38) (compounds of specific example compound Nos. (1) to (38), that is, specific thiazolothiazole compounds (1) to (38)) of a thiazolothiazole compound represented by Formula (I) will be described below, but the invention is not limited to the specific example compounds.

$R^1$, Ar, q, and n in specific example compounds (1) to (38) have the same definitions as $R^1$, Ar, q, and n in Formula (I).

| Specific Example Compound No. | Ar | n | q | $R^1$ |
|---|---|---|---|---|
| (1) | 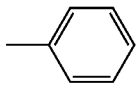 | 0 | 0 | $CH_3$ |
| (2) | 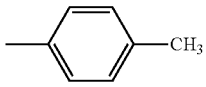 | 0 | 0 | $CH_3$ |
| (3) | 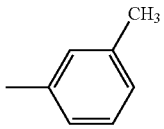 | 0 | 0 | $CH_3$ |
| (4) | 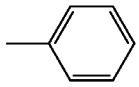 | 1 | 0 | $CH_3$ |
| (5) | 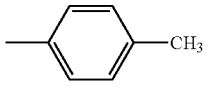 | 1 | 0 | $CH_3$ |

-continued

| Specific Example Compound No. | Ar | n | q | $R^1$ |
|---|---|---|---|---|
| (6) | 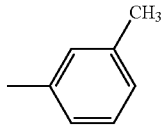 | 1 | 0 | $CH_3$ |
| (7) | 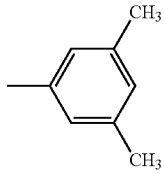 | 1 | 0 | $CH_3$ |
| (8) | 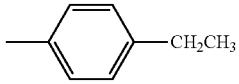 | 1 | 0 | $CH_3$ |
| (9) | 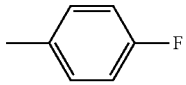 | 1 | 0 | $CH_3$ |
| (10) | 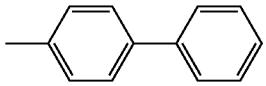 | 1 | 0 | $CH_3$ |
| (11) | 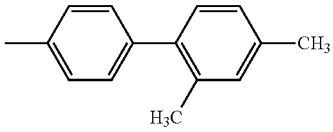 | 1 | 0 | $CH_3$ |
| (12) | 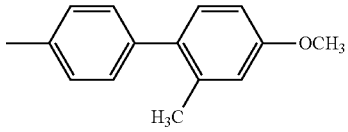 | 1 | 0 | $CH_3$ |
| (13) | 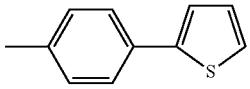 | 1 | 0 | $CH_3$ |
| (14) | 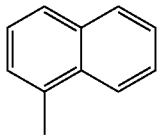 | 1 | 0 | $CH_3$ |
| (15) | 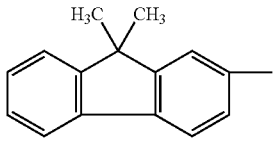 | 1 | 0 | $CH_3$ |

-continued
| Specific Example Compound No. | Ar | n | q | $R^1$ |
|---|---|---|---|---|
| (16) | 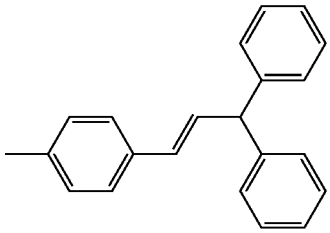 | 1 | 0 | $CH_3$ |
| (17) | 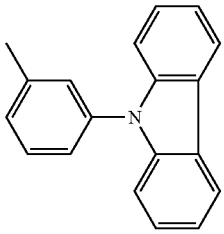 | 1 | 0 | $CH_3$ |
| (18) | 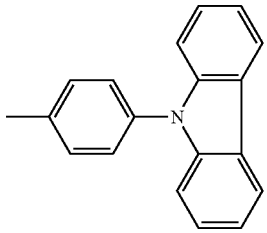 | 1 | 0 | $CH_3$ |
| (19) | 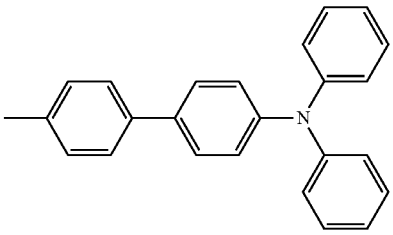 | 1 | 0 | $CH_3$ |
| (20) | 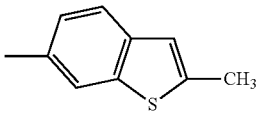 | 1 | 0 | $CH_3$ |
| (21) | 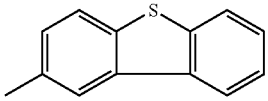 | 1 | 0 | $CH_3$ |
| (22) | 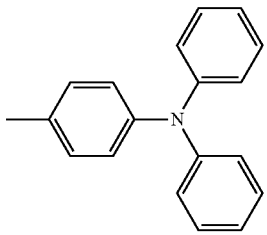 | 1 | 0 | $CH_3$ |
-continued
| Specific Example Compound No. | Ar | n | q | $R^1$ |
|---|---|---|---|---|
| (23) | 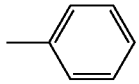 | 1 | 1 | $CH_3$ |
| (24) | 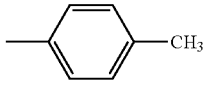 | 1 | 1 | $CH_3$ |
| (25) | 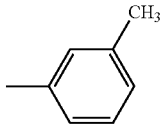 | 1 | 1 | $CH_3$ |
| (26) | 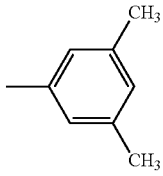 | 1 | 1 | $CH_3$ |
| (27) | 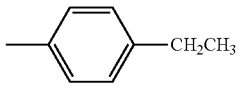 | 1 | 1 | $CH_3$ |
| (28) | 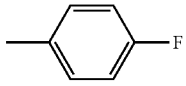 | 1 | 1 | $CH_3$ |
| (29) | 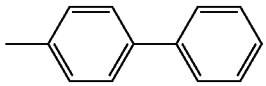 | 1 | 1 | $CH_3$ |
| (30) | 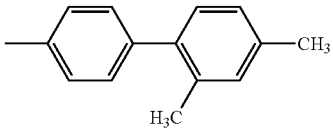 | 1 | 1 | $CH_3$ |
| (31) | 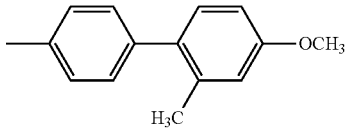 | 1 | 1 | $CH_3$ |
| (32) | 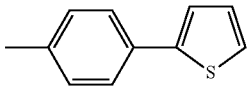 | 1 | 1 | $CH_3$ |
| (33) | 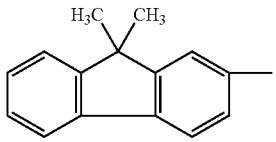 | 1 | 1 | $CH_3$ |

-continued

| Specific Example Compound No. | Ar | n | q | $R^1$ |
|---|---|---|---|---|
| (34) | 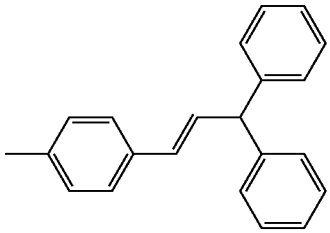 | 1 | 1 | $CH_3$ |
| (35) | 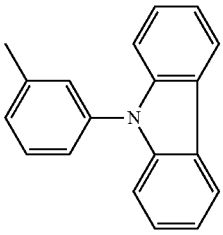 | 1 | 1 | $CH_3$ |
| (36) | 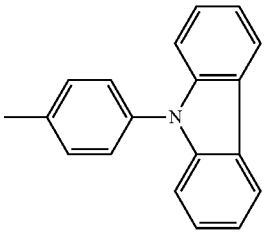 | 1 | 1 | $CH_3$ |
| (37) | 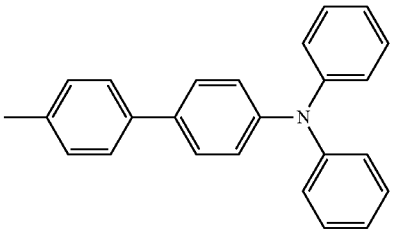 | 1 | 1 | $CH_3$ |
| (38) | 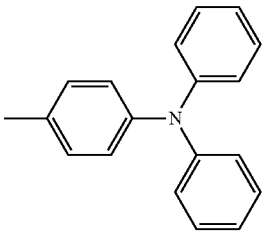 | 1 | 1 | $CH_3$ |

<Method of Producing Compound Represented by Formula (I)>

Hereinafter, a method of producing the compound represented by Formula (I) will be described in detail.

In the exemplary embodiment, for example, by causing a coupling reaction of a halogen compound represented by Formula (VI) and a diarylamine compound represented by Formula (VII) with a copper catalyst or causing a coupling reaction of a diarylamine compound represented by Formula (VIII) and a halogen compound represented by Formula (IX) with a copper catalyst, a triarylamine derivative represented by Formula (X) may be obtained.

Then, by causing triarylamine (X) to react with a formylation agent such as N,N-dimethylformamide or N-methylformanilide in the presence of phosphorous oxychloride, formylated product (XI) of a triarylamine derivative may be obtained. Formylated product (XI) of the triarylamine derivative is caused to react with a rubeanic acid, whereby a thiazolothiazole compound may be obtained.

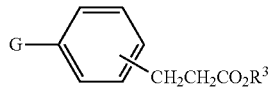

(VI)

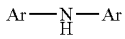

(VII)

In Formula (VI), $R^3$ represents a hydrogen atom, an alkyl group, a substituted or unsubstituted aryl group, or a substituted or unsubstituted aralkyl group, and G represents a bromine atom or an iodine atom. Ar in Formula (VII) has the same definition as Ar in Formula (I).

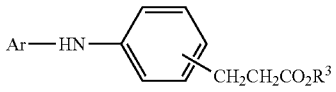

(VIII)

(IX)

In Formula (VIII), $R^3$ represents a hydrogen atom, an alkyl group, a substituted or unsubstituted aryl group, or a substituted or unsubstituted aralkyl group, and Ar has the same definition as described above. In Formula (IX), Ar and G have the same definitions as described above.

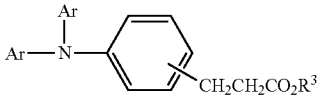

(X)

In Formula (X), Ar and $R^3$ have the same definitions as described above.

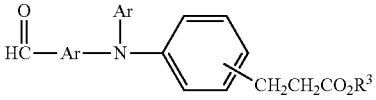

(XI)

In Formula (XI), Ar and $R^3$ have the same definitions as described above.

In the coupling reaction, for example, from 0.5 equivalent to 1.5 equivalent (or from 0.7 equivalent to 1.2 equivalent) of the halogen compound represented by Formula (VI) or Formula (IX) with respect to one equivalent of the compound represented by Formula (VII) or Formula (VIII) may be used.

Examples of the copper catalyst used in the coupling reaction include copper powder, copper oxide, and copper sulfate. The amount of the copper catalyst may be in the range of from 0.001 parts by weight to 3 parts by weight with respect to one part by weight of the compound represented by Formula (VII)

or Formula (VIII), or may be in the range of from 0.01 parts by weight to 2 parts by weight.

A base is used in the coupling reaction, and examples of the base include sodium hydroxide, potassium hydroxide, sodium carbonate, and potassium carbonate. The amount of the base may be in the range of from 0.5 equivalent to 3 equivalent with respect to one equivalent of the compound represented by Formula (VII) or Formula (VIII), or may be in the range of from 0.7 equivalent to 2 equivalent.

The reaction may use a solvent or may not use a solvent. When a solvent is used, examples of the solvent include a high boiling-point water-insoluble hydrocarbon solvent such as n-tridecane, tetralin, p-cymene, or terpinolene and a high boiling-point halogen solvent such as o-dichlorobenzene or chlorobenzene. The amount of the solvent to be used may be in the range of from 0.1 parts by weight to 3 parts by weight with respect to one part by weight of the compound represented by Formula (VII) or Formula (VIII), or may be in the range of from 0.2 parts by weight to 2 parts by weight.

The above reaction may be carried out in the atmosphere of inert gas such as nitrogen or argon in the temperature range of from 100° C. to 300° C., in the temperature range of from 150° C. to 270° C., or in the temperature range of 180° C. to 230° C. while efficiently stirring and removing water generated in the reaction.

After the end of the reaction, the resultant product is cooled as needed, and is hydrolyzed using a solvent such as methanol, ethanol, n-octanol, ethylene glycol, propylene glycol, or glycerin and a base such as sodium hydroxide or potassium hydroxide.

The amount of the solvent used in the hydrolysis may be in the range of from 0.5 parts by weight to 10 parts by weight with respect to one part by weight of the compound represented by Formula (VII) or Formula (VIII), or may be in the range of from 1 part by weight to 5 parts by weight. The amount of the base used in the hydrolysis may be in the range of from 0.2 parts by weight to 5 parts by weight with respect to one part by weight of the compound represented by Formula (VII) or Formula (VIII), or may be in the range of from 0.3 parts by weight to 3 parts by weight.

The solvent and the base are added to the reaction solution after the end of the coupling reaction, and the hydrolysis reaction is carried out with stirring in the atmosphere of inert gas such as nitrogen or argon in the temperature range of from 50° C. to the boiling point of the solvent.

In this case, since a carboxylate salt is generated and solidified due to the coupling reaction, a solvent having a boiling point of 150° C. or higher may be used as the solvent to raise the reaction temperature.

After the end of the hydrolysis reaction, by adding water to the reaction product and neutralizing the resultant product with a hydrochloric acid or the like, the triarylamine compound represented by Formula (X) is isolated. In the post process of the hydrolysis, in order to isolate the triarylamine compound represented by Formula (X) by adding water and then neutralizing the resultant product with the hydrochloric acid or the like, water-soluble ethylene glycol, propylene glycol, or glycerin may be added thereto.

Then, the resultant product is cleaned, is dissolved in a solvent as needed, and is subjected to a column purification with silica gel, alumina, activated white earth, or activated carbon, or is subjected to a process of adsorbing unnecessary components with the adsorbent added to the solution. The resultant product may be subjected to a re-crystallization process using the solvent such as acetone, ethanol, ethyl acetate, or toluene, or may be esterified to be methylester or ethylester and then may be subjected to the re-crystallization process.

By causing the obtained triarylamine compound represented by Formula (X) to react with the formylation agent such as N,N-dimethylformamide or N-methylformanilide in the presence of phosphorous oxychloride, formylated product (XI) of the triarylamine derivative may be obtained. In this case, the formylation agent may be also used as a reaction solvent by excessively using the formylation agent, or an inert solvent may be used as a solvent, such as o-dichlorobenzene, benzene, or methylene dichloride. The reaction temperature may be in the range of from 0° C. to the boiling point of the solvent, or may be in the range of 27° C. to 150° C.

Then, by causing a cyclization reaction of the formylated product of the triarylamine derivative represented by Formula (XI) with a rubeanic acid, the thiazolothiazole compound represented by Formula (I) may be obtained.

The amount of the rubeanic acid used in the cyclization reaction of the formylated product of the triarylamine derivative with a rubeanic acid may be in the range of from 1.5 equivalent to 5 equivalent with respect to one equivalent of the compound represented by Formula (XI), or may be in the range of from 1.7 equivalent to 4 equivalent.

In the cyclization reaction, a solvent may be used as needed. Examples of the solvent include a high boiling-point water-insoluble hydrocarbon solvent such as n-tridecane, tetralin, p-cymene, or terpinolene and a high boiling-point halogen solvent such as o-dichlorobenzene or chlorobenzene. The amount of the solvent to be used may be in the range of from 0.1 parts by weight to 3 parts by weight with respect to one part by weight of the formylated product of the triarylamine derivative represented by Formula (XI), or may be in the range of from 0.2 parts by weight to 2 parts by weight.

The cyclization reaction may be carried out in the atmosphere of inert gas such as nitrogen or argon in the temperature range of from 100° C. to 300° C., in the temperature range of from 150° C. to 270° C., or in the temperature range of 180° C. to 250° C. while efficiently stirring and removing water generated in the reaction. After the end of the reaction, the reaction product is dissolved in a solvent such as toluene or isopar, n-tridecane, unnecessary components are removed therefrom by water washing or filtration as needed, the resultant product is subjected to a column purification process with silica gel, alumina, activated white earth, or activated carbon, or is subjected to a process of adsorbing unnecessary components with the adsorbent added to the solution. The resultant product is subjected to a re-crystallization process for purification using the solvent such as ethanol, ethyl acetate, or toluene.

<Compound (Polyester) Including Structural Unit Represented by Formula (II-3)>

The compound including a structural unit represented by Formula (II-3) will be described below in detail.

In the exemplary embodiment, polyester represented by Formula (II-1) is used as the compound including a structural unit represented by Formula (II-3).

Formula (II-3)

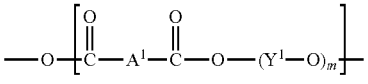

In Formula (II-3), $Y^1$'s each independently represent a substituted or unsubstituted bivalent hydrocarbon group, m represents an integer of from 1 to 5, and $A^1$ represents a group represented by Formula (II-2).

Formula (II-2)

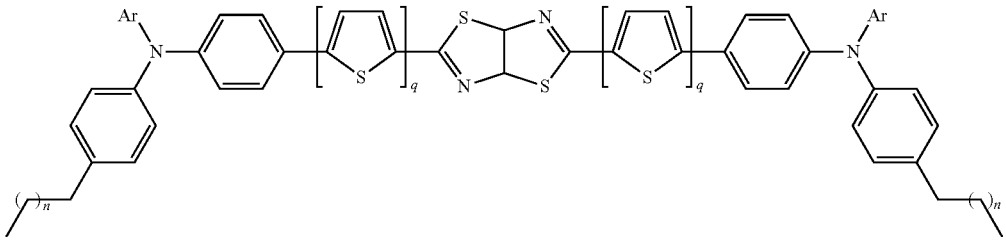

In Formula (II-2), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group, q represents 0 or 1, and n's each independently represent an integer of from 0 to 7.

The polyester including a structural unit represented by Formula (II-3) includes a structural unit $A^1$ derived from the thiazolothiazole compound represented by Formula (I). Since the polyester including a structural unit represented by Formula (II-3) is a polymer, it has higher thermal resistance than a charge transport material such as N,N'-diphenyl-N,N'-di(m-tolyl)benzidine which is a low molecular-weight compound.

Therefore, the polyester including a structural unit represented by Formula (II-3) may be suitably used in the image holding member for an image forming apparatus.

Since the polymer including a structural unit represented by Formula (II-3) has an ester structure, it is easy to synthesize and produce a polymer having the structural unit $A^1$ derived from the thiazolothiazole compound represented by Formula (I).

Formula (II-3) will be described below in detail.

In Formula (II-3), $Y^1$'s each independently represent a substituted or unsubstituted bivalent hydrocarbon group.

The bivalent hydrocarbon group represented by $Y^1$ is a dihydric alcohol residue, and examples thereof include an alkylene group, a (poly)oxy ethylene group, a (poly)oxy propylene group, an arylene group, a bivalent heterocyclic group, and combinations thereof.

An example of the bivalent hydrocarbon group represented by $Y^1$ may be a linking group having a small carbon number in view of the compatibility with a resin and the charge transport property. Specifically, the carbon number may be in the range of from 1 to 18 or in the range of from 1 to 6.

An example of the bivalent hydrocarbon group represented by $Y^1$ may be a linking group having a small dipole moment in view of the charge transport property. A specific example thereof is a linking group not including any atom (such as an oxygen atom, a nitrogen atom, or a sulfur atom) other than a carbon atom and a hydrogen atom.

That is, an alkylene group having from 1 to 10 carbon atoms or an arylene group having from 6 to 18 carbon atoms may be used as the bivalent hydrocarbon group represented by $Y^1$, and the alkylene group having from 1 to 6 carbon atoms may be used.

A specific example of $Y^1$ in Formula (II-3) is a group selected from the following Formulas (1) to (7).

(1) $-(CH_2)_d-$ (2) $-(CH_2CH_2O)_e-(CH_2CH_2)-$

-continued (3)

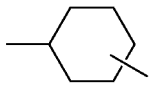

(4)

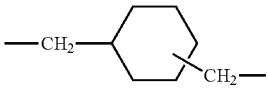

(5)

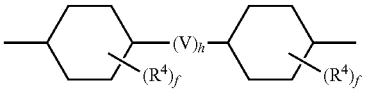

(6)

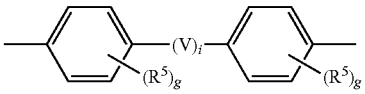

(7)

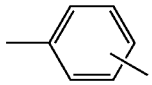

In Formulas (1) and (2), d and e each independently represent an integer of from 1 to 10.

In Formulas (5) and (6), $R^4$ and $R^5$ each independently represent an alkyl group having from 1 to 4 carbon atoms, an alkoxy group having from 1 to 4 carbon atoms, a substituted or unsubstituted phenyl group, a substituted or unsubstituted aralkyl group, or a halogen atom.

In Formulas (5) and (6), f and g each represent an integer of 0, 1, or 2, h and i each represent 0 or 1, and V represents a group selected from the following Formulas (8) to (28).

(8) $-(CH_2)_b-$ (9) $-C(CH_3)_2-$

(10) $-O-$

(11) $-S-$

(12) $-C(CF_3)_2-$

(13) $-Si(CH_3)_2-$ (14)

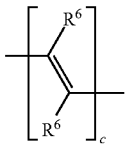

-continued (15)

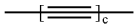

(16)

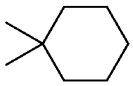

(17)

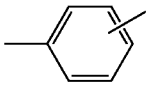

(18)

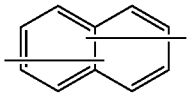

(19)

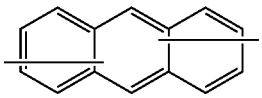

(20)

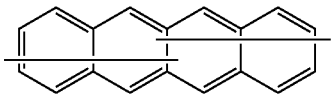

(21)

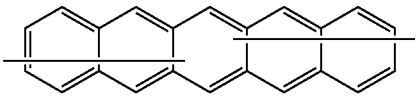

(22)

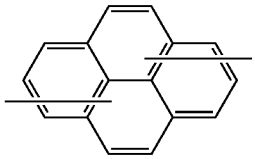

(23)

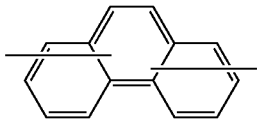

(24)

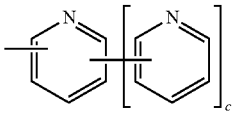

-continued (25)

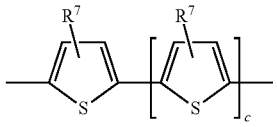

(26)

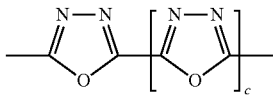

(27)

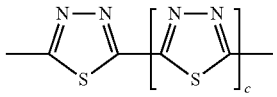

(28)

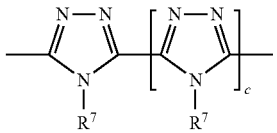

In Formula (8), b represents an integer of from 1 to 10, an integer of from 1 to 6, or an integer of from 1 to 4.

In Formula (14), $R^6$'s each independently represent a hydrogen atom, an alkyl group, or a cyano group.

In Formulas (25) and (28), $R^7$'s each independently represent a hydrogen atom, an alkyl group having from 1 to 10 carbon atoms, an alkoxy group having from 1 to 10 carbon atoms, a substituted or unsubstituted phenyl group, a substituted or unsubstituted aralkyl group, or a halogen atom.

In Formulas (14), (15), and (24) to (28), c's each independently represent an integer of from 0 to 10, an integer of from 0 to 6, or an integer of from 1 to 3.

Two or more $Y^1$s existing in the compound including a structural unit represented by Formula (II-3) may be equal to or different from each other, but may be equal to each other in view of production.

In Formula (II-3), m represents an integer of from 1 to 5, and m may be an integer of from 1 to 3 in view of both the solubility and the increase in molecular weight, or may be an integer of from 1 to 2 in view of the increase in molecular weight.

In Formula (II-3), $A^1$ represents a group represented by the following Formula (II-2).

Formula (II-2)

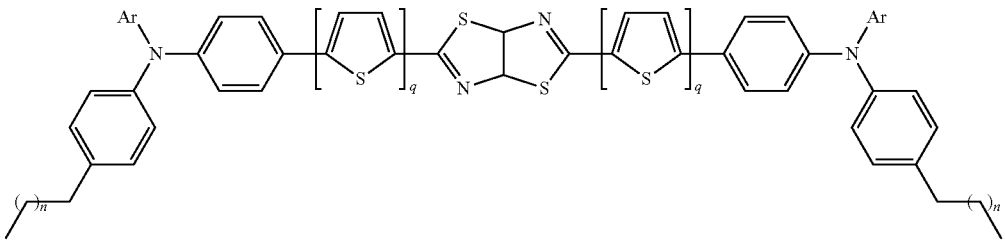

In Formula (II-2), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group, q represents 0 or 1, and n's each independently represent an integer of from 0 to 7.

Ar, q, and n in Formula (II-2) have the same definitions as Ar, q, and n in Formula (I) and their exemplary ranges are also the same.

Two or more $A^1$'s existing in the compound including a structural unit represented by Formula (II-3) may be equal to each other or may include two or more kinds.

Examples of the polyester including a structural unit represented by Formula (II-3) include polyester represented by the following Formula (II-1) and polyester represented by the following Formula (II-4). Since both include structural unit $A^1$ derived from Formula (I) (that is, the group represented by the above Formula (II-2)), the charge transport property and the compatibility with a resin are both excellent and it is suitable for the image holding member for an image forming apparatus.

The thiazolothiazole-containing polyester represented by the following Formula (II-1) includes $A^1$ as a carboxylate residue, and the thiazolothiazole-containing polyester represented by the following Formula (II-4) includes $A^1$ and $Z^1$ as carboxylate residues. Therefore, the thiazolothiazole-containing polyester represented by Formula (II-1) is excellent in view of easy synthesis, and the thiazolothiazole-containing polyester represented by Formula (II-4) may be suitably used in an organic photoreceptor for an image forming apparatus by virtue of the carboxylate residue $Z^1$.

Formula (II-1)

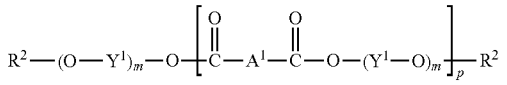

In Formula (II-1), $Y^1$'s each independently represent a substituted or unsubstituted bivalent hydrocarbon group, $A^1$ represents a group represented by the above Formula (II-2), $R^2$'s each independently represent a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, a monovalent linear hydrocarbon group having from 1 to 6 carbon atoms, a monovalent branched hydrocarbon group having from 2 to 10 carbon atoms, or a hydrogen atom, m's each independently represent an integer of from 1 to 5, and p represents an integer of from 5 to 5,000.

That is, $Y^1$, $A^1$, and m in Formula (II-1) have the same definitions as $Y^1$, $A^1$, and m in Formula (II-3).

Formula (II-4)

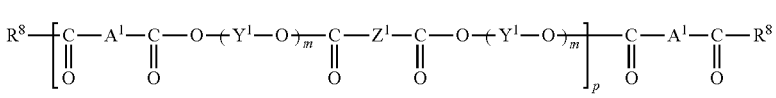

$Y^1$, $A^1$, m, and p in Formula (II-4) have the same definitions as $Y^1$, $A^1$, m, and p in Formulas (II-3) and (II-1). $R^8$'s each independently represent a group represented by —O—($Y^1$—O)$_m$—H or —O—($Y^1$—O)$_m$—CO—$Z^1$—CO—O$R^2$. Here, $R^2$ has the same definition as $R^2$ in Formula (II-1). $Z^1$ represents a bivalent hydrocarbon group (that is, a carboxylate residue).

In Formulas (II-1) and (II-4), p's each independently represent an integer of from 5 to 5,000. In view of the solubility in a general solvent when it is used as a coating composition (coating liquid), p may be an integer of from 5 to 2,000. p may be an integer of from 5 to 600 in view of easy synthesis, or may be an integer of from 5 to 500 in view of molecular dispersability Mw/Mn.

When p is in the range of from 5 to 5,000, the ionization potential is substantially not affected by the value of p, and even if affected, the ionization potential will vary by about 0.01 eV or less.

In Formula (II-1), $R^2$'s each independently represent a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, a monovalent linear hydrocarbon group having from 1 to 6 carbon atoms, a monovalent branched hydrocarbon group having from 2 to 10 carbon atoms, or a hydrogen atom. $R^2$ included in the group represented by $R^8$ in Formula (II-4) has the same definition as $R^2$ in Formula (II-1).

Specifically, $R^2$ may be a hydrogen atom or a methyl group, and in view of cost reduction and easy production, $R^2$ may be a hydrogen atom.

Two $R^2$'s in Formulas (II-1) and (II-4) may be equal to or different from each other, but may be equal to each other in view of production. Two $R^8$'s in Formula (II-4) may be equal to or different from each other, but may be equal to each other in view of production.

$Z^1$ in Formula (II-4) represents a bivalent carboxylate residue.

Specifically, it has the same definition as the bivalent linking group represented by $Y^1$ in Formula (II-3), and the exemplary range is also the same. Plural $Z^1$'s in Formula (II-4) may be equal to or different from each other, but may be equal to each other in view of production.

Plural $A^1$'s in Formulas (II-1) and (II-4) may be equal to or different from each other, but may be equal to each other in view of production.

Plural m's in Formulas (II-1) and (II-4) may be equal to or different from each other, but may be equal to each other in view of production.

The polyester including a structural unit derived from the compound represented by Formula (I), such as those represented by Formulas (II-1) and (II-4), may have a weight-average molecular weight Mw in the range of from 5,000 to 300,000. In view of the solubility in a solvent when it is used as a coating liquid, the weight-average molecular weight may be in the range of from 10,000 to 200,000 or in the range of from 30,000 to 150,000.

The weight-average molecular weight is an average molecular weight in terms of polystyrene measured by a gel permeation chromatography (carrier: tetrahydrofuran).

Specific example polymers 1 to 32 (that is, Specific Thiazolothiazole-containing Polyesters 1 to 32) of the thiazolothiazole-containing polyester represented by Formula (II-1) are described below, but the exemplary embodiment is not limited to the specific examples.

The number in the column of monomer (column of "Structure No. of $A^1$") for the specific example polymer corresponds to the specific example compound No. of the compound represented by Formula (I). For example, the structure of $A^1$ denoted by number 15 means the structure derived from specific example compound (15).

$Y^1$, m, p, and $R^2$ in the specific example polymers have the same definitions as $Y^1$, m, p, and $R^2$ in Formula (II-1).

| Specific Example Polymer No. | Structure No. of $A^1$ | $Y^1$ | m | p | $R^2$ |
|---|---|---|---|---|---|
| 1 | 1 | $-(CH_2)_2-$ | 1 | 88 | $CH_3$ |
| 2 | 1 | $-(CH_2)_6-$ | 1 | 73 | $CH_3$ |
| 3 | 1 | 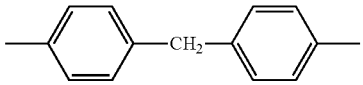 | 1 | 58 | $CH_3$ |
| 4 | 1 | 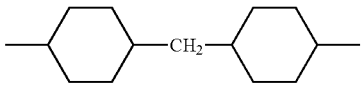 | 1 | 89 | $CH_3$ |
| 5 | 1 | 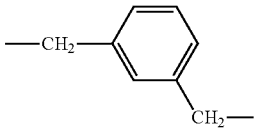 | 1 | 76 | $CH_3$ |
| 6 | 4 | $-(CH_2)_2-$ | 1 | 75 | $CH_3$ |
| 7 | 4 | 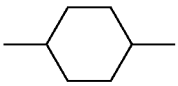 | 1 | 103 | $CH_3$ |
| 8 | 4 | 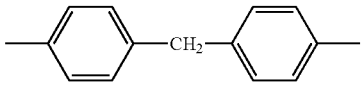 | 1 | 70 | $CH_3$ |
| 9 | 4 | 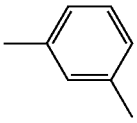 | 1 | 70 | $CH_3$ |
| 10 | 5 | $-(CH_2)_2-$ | 1 | 86 | $CH_3$ |
| 11 | 6 | $-(CH_2)_6-$ | 1 | 86 | $CH_3$ |
| 12 | 8 | $-(CH_2)_2-$ | 1 | 87 | $CH_3$ |
| 13 | 9 | 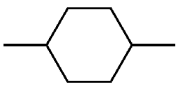 | 1 | 98 | $CH_3$ |
| 14 | 10 | $-(CH_2)_6-$ | 1 | 57 | $CH_3$ |
| 15 | 12 | $-(CH_2)_2-$ | 1 | 64 | $CH_3$ |
| 16 | 13 | $-(CH_2)_2-$ | 1 | 58 | $CH_3$ |

-continued

| Specific Example Polymer No. | Structure No. of $A^1$ | $Y^1$ | m | p | $R^2$ |
|---|---|---|---|---|---|
| 17 | 13 | 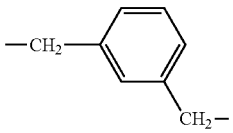 | 1 | 79 | $CH_3$ |
| 18 | 15 | $-(CH_2)_2-$ | 1 | 81 | $CH_3$ |
| 19 | 15 | 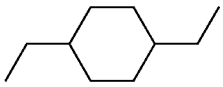 | 1 | 46 | $CH_3$ |
| 20 | 19 | $-(CH_2)_6-$ | 1 | 91 | $CH_3$ |
| 21 | 23 | $-(CH_2)_2-$ | 1 | 81 | $CH_3$ |
| 22 | 23 | 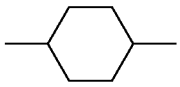 | 1 | 101 | $CH_3$ |
| 23 | 24 | 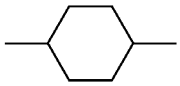 | 1 | 80 | $CH_3$ |
| 24 | 25 | $-(CH_2)_2-$ | 1 | 73 | $CH_3$ |
| 25 | 26 | $-(CH_2)_2-$ | 1 | 69 | $CH_3$ |
| 26 | 30 | $-(CH_2)_2-$ | 1 | 85 | $CH_3$ |
| 27 | 32 | $-(CH_2)_2-$ | 1 | 86 | $CH_3$ |
| 28 | 32 | $-(CH_2)_6-$ | 1 | 76 | $CH_3$ |
| 29 | 33 | $-(CH_2)_2-$ | 1 | 86 | $CH_3$ |
| 30 | 35 | 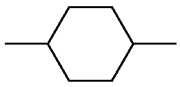 | 1 | 104 | $CH_3$ |
| 31 | 37 | $-(CH_2)_2-$ | 1 | 78 | $CH_3$ |
| 32 | 38 | $-(CH_2)_2-$ | 1 | 70 | $CH_3$ |

As the synthesis method of the polyester including the structural unit represented by Formula (II-1), known methods may be combined and used depending on a desired structure. The synthesis method is not particularly limited, but an example of the synthesis method of thiazolothiazole-containing polyester used in the image holding member for an image forming apparatus according to the exemplary embodiment will be described below.

The thiazolothiazole-containing polyester represented by Formula (II-1) may be obtained by polymerizing monomers represented by the following Formula (I-3) using a known method described in the fourth edition of "JIKKEN KAGAKU KOZA" (The Fourth Series of Experimental Chemistry), vol. 28, (MARUZEN CO., LTD., 1992) or the like.

Formula (I-3)

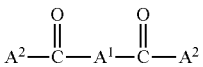

In Formula (I-3), $A^1$ represents a partial structure derived from at least one kind selected from compounds represented by Formula (I) and has the same definition as $A^1$ in Formula (II-1). $A^2$ represents a hydroxyl group, a halogen atom, or —O—$R^9$ and $R^9$ represents an alkyl group, a substituted or unsubstituted aryl group, or an aralkyl group.

That is, the thiazolothiazole-containing polyester represented by Formula (II-1) is synthesized as follows.

(1) Case Where $A^2$ is Hydroxyl Group

A dihydric alcohol represented by HO—$(Y^1$—O$)_m$—H is equivalently mixed with the compound represented by Formula (I-3), and the resultant mixture is polymerized with an acid catalyst. $Y^1$ represents a dihydric alcohol residue and has the same definition as $Y^1$ in Formula (II-1). Here, m represents an integer in the range of from 1 to 5 and has the same definition as m in Formula (II-1).

Catalysts such as sulfuric acid, toluene sulfonic acid, or trifluoro acetic acid generally used in an esterification reaction are used as the acid catalyst, and the amount thereof to be used may be in the range of from 1/10,000 parts by weight to 1/10 parts by weight with respect to 1 part by weight of a monomer (that is, the compound represented by Formula (I-3)), or may be in the range of from 1/1,000 parts by weight to 1/50 parts by weight.

To remove water generated in the polymerization, an azeotropic solvent may be used, and toluene, chlorobenzene, 1-chloronaphthalene or the like may be effectively used. The amount thereof to be used may be in the range of from 1 part by weight to 100 parts by weight with respect to 1 part by weight of a monomer, or may be in the range of from 2 parts by weight to 50 parts by weight.

The reaction temperature is set depending on the condition, and the reaction may be carried out at the boiling point of the solvent to remove water generated in the polymerization.

After the end of the reaction, when no solvent is used, the resultant product is dissolved in a soluble solvent. When a solvent is used, the reaction solution is dropped in a poor solvent in which the polymer is hardly dissolved, such as acetone or alcohols such as methanol or ethanol, polyester is precipitated, polyester is separated, and the resultant product is sufficiently washed with water or an organic solvent and is then dried.

If necessary, a re-precipitation process of dissolving the resultant product in a suitable organic solvent, dropping the resultant solution in a poor solvent, and precipitating polyester may be repeatedly performed. The re-precipitation process may be carried out while efficiently stirring with a mechanical stirrer. The amount of the solvent for dissolving polyester at the time of re-precipitation may be in the range of from 1 part by weight to 100 parts by weight with respect to 1 part by weight of polyester or may be in the range of from 2 parts by weight to 50 parts by weight. The amount of the poor solvent to be used may be in the range of from 1 part by weight to 1,000 parts by weight with respect to 1 part by weight of polyester or may be in the range of from 10 parts by weight to 500 parts by weight.

(2) Case Where $A^2$ is Halogen Atom

A dihydric alcohol represented by HO—$(Y^1$—O$)_m$—H is equivalently mixed with the compound represented by Formula (I-3), and the resultant mixture is polymerized with an organic basic catalyst such as pyridine or triethylamine. $Y^1$ represents a dihydric alcohol residue and has the same definition as $Y^1$ in Formula (II-1). In the formula, m represents an integer in the range of from 1 to 5 and has the same definition as m in Formula (II-1).

The amount of the organic basic catalyst to be used is in the range of from 1 equivalent to 10 equivalent with respect to 1 equivalent of a monomer and may be in the range of from 2 equivalent to 5 equivalent.

Methylene dichloride, tetrahydrofuran (THF), toluene, chlorobenzene, or 1-chloronaphthalene may be effectively used as the solvent. The amount thereof is in the range of from 1 part by weight to 100 parts by weight with respect to 1 part by weight of a monomer and may be in the range of from 2 parts by weight to 50 parts by weight.

The reaction temperature is set depending on the conditions. After the polymerization, the resultant product is re-precipitated and purified as described above.

When a dihydric alcohol such as bisphenol having high acidity is used, an interfacial polymerization method may be used. That is, a dihydric alcohol is added to water, a base is equivalently added thereto, the resultant mixture is dissolved, and a solution of an equivalent amount of a monomer is added thereto while stirring intensely, whereby the polymerization reaction is carried out. At this time, the amount of water to be used is in the range of from 1 part by weight to 1,000 parts by weight with respect to 1 part by weight of the dihydric alcohol and may be in the range of from 2 parts by weight to 500 parts by weight. Methylene dichloride, dichloroethane, trichloroethane, toluene, chlorobenzene, or 1-chloronaphthalene may be effectively used as the solvent for dissolving the monomer.

The reaction temperature is set depending on the conditions. A phase-transfer catalyst such as an ammonium salt or a sulfonium salt is effectively used to promote the reaction. The amount of the phase-transfer catalyst to be used is in the range of from 0.1 parts by weight to 10 parts by weight with respect to 1 part by weight of the monomer and may be in the range of from 0.2 parts by weight to 5 parts by weight.

(3) Case Where $A^2$ is —O—$R^9$

A dihydric alcohol represented by HO—$(Y^1$—O$)_m$—H is excessively added to the compound represented by Formula (I-3), and the resultant mixture is heated using an inorganic acid such as a sulfuric acid or a phosphoric acid, titanium alkoxide, an acetate salt or a carbonate salt of calcium or cobalt, or an oxide of zinc or lead as a catalyst, whereby the synthesis is carried out by ester exchange. $Y^1$ represents a dihydric alcohol residue and has the same definition as $Y^1$ in Formula (II-1). Here, m represents an integer in the range of from 1 to 5 and has the same definition as m in Formula (II-1).

The amount of the dihydric alcohol to be used is in the range of from 2 equivalent to 100 equivalent with respect to 1 equivalent of the monomer (the compound represented by Formula (I-3)) and may be in the range of from 3 equivalent to 50 equivalent. The amount of the catalyst to be used is in the range of from 1/10,000 parts by weight to 1 part by weight with respect to 1 part by weight of the monomer and may be in the range of from 1/1,000 parts by weight to 1/2 parts by weight.

The reaction may be carried out at a reaction temperature of from 200° C. to 300° C., and after the end of the ester exchange from —O—$R^9$ to —O—$(Y^1$—O$)_m$—H, the reaction may be carried out under a depressurized condition to promote the polymerization by elimination of HO—$(Y^1$—O$)_m$—H. The reaction may be carried out while removing HO—$(Y^1$—O$)_m$—H by azeotropy at a normal pressure using a high boiling-point solvent such as 1-chloronaphthalene, which is an azeotropic solvent of HO—$(Y^1$—O$)_m$—H.

The polyester may also be synthesized as follows.

In the respective cases described above, the compound represented by the following Formula (I-4) is produced by causing the reaction with the excessive dihydric alcohol added thereto, and this compound instead of the monomer represented by Formula (I-3) is caused to react with a bivalent carboxylic acid or a bivalent carboxylic acid halide, whereby the thiazolothiazole-containing polyester represented by Formula (II-1) may be obtained.

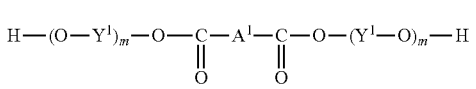

(I-4)

In Formula (I-4), $A^1$ represents a partial structure derived from at least one kind selected from compounds represented by Formula (I) and has the same definition as $A^1$ in Formula (II-1). $Y^1$ represents a dihydric alcohol residue and has the same definition as $Y^1$ in Formula (II-1). Here, m represents an integer in the range of from 1 to 5 and has the same definition as m in Formula (II-1).

A molecule may be introduced into a terminal of the thiazolothiazole-containing polyester. In this case, the following method may be used. That is, when $A^2$ is a hydroxyl group, a monocarboxylic acid of a terminal-introducing compound is co-polymerized, or after a polymerization reaction of a polymer is finished, a monocarboxylic acid is added to react with the electron transporting compound, whereby the molecule is introduced.

When $A^2$ is halogen, a monoacid chloride of a terminal-introducing compound is co-polymerized, or after a polymerization reaction of a polymer is finished, a monoacid chloride of a terminal-introducing compound is added thereto to react with the polymer, whereby the molecule is introduced. When $A^2$ is —O—$R^9$, a monoester of a terminal-introducing compound is co-polymerized, or after a polymerization reaction of a polymer is finished, a monoester of a terminal-introducing compound is added thereto to react with the polymer, whereby the molecule is introduced.

In the image holding member for an image forming apparatus according to the exemplary embodiment, as described above, at least one of the compound represented by Formula (I) or the compound represented by Formula (II-1) is included in the photosensitive layer. Therefore, since at least one of the compound represented by Formula (I) or the compound represented by Formula (II-1) has a charge transport property, a residual potential variation due to repeated use is small and an excellent environmental sustainability is exhibited.

In the image holding member for an image forming apparatus according to the exemplary embodiment, at least one of the compound represented by Formula (I) or the compound represented by Formula (II-1) has excellent compatibility with a resin. Accordingly, even when a binder resin is used in the photosensitive layer, the thickness unevenness of the photosensitive layer is small and the variation in residual potential due to the repeated use of the image holding member is small.

In the image forming apparatus and the process cartridge according to the exemplary embodiment, since the image holding member for an image forming apparatus according to the exemplary embodiment is used, it is possible to obtain excellent image quality for a long time, thereby reducing the environmental load and greatly reducing the cost.

<Configuration of Image Holding Member for Image Forming Apparatus>

The configuration of the image holding member for an image forming apparatus according to the exemplary embodiment will be described.

The image holding member for an image forming apparatus according to the exemplary embodiment is an image holding member having a photosensitive layer on a substrate, in which the photosensitive layer includes at least one of the compound represented by Formula (I) or the compound represented by Formula (II-1).

Figure 2:
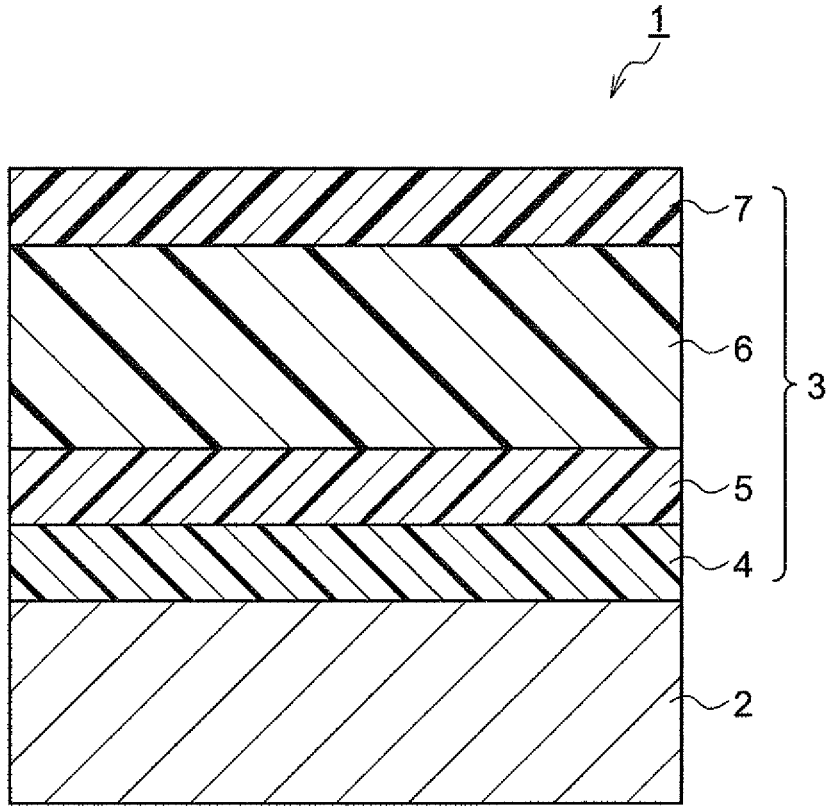
FIG. 2 is a schematic sectional view of an image holding member for an image forming apparatus according to a second exemplary embodiment of the invention.
Figure 3:
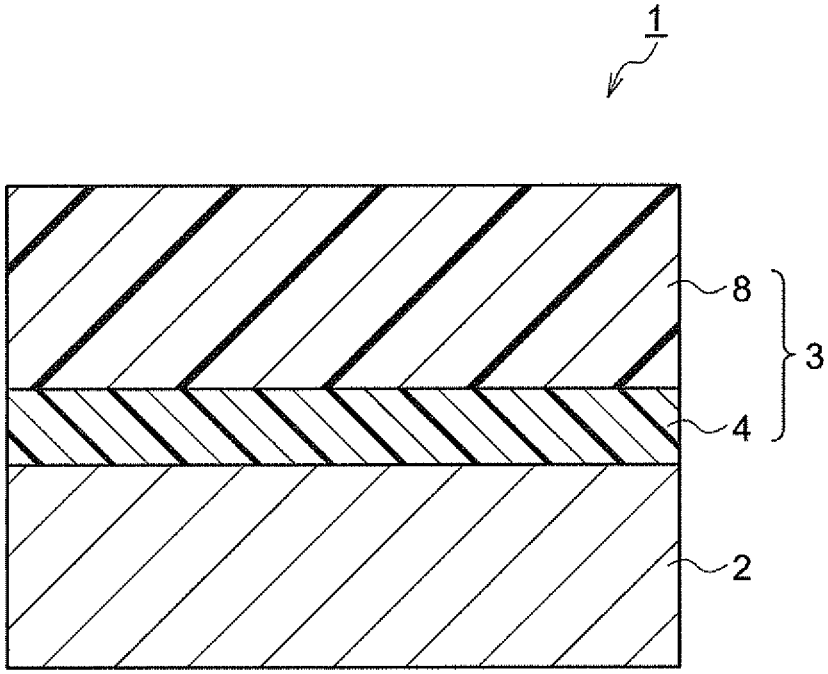
FIG. 3 is a schematic sectional view of an image holding member for an image forming apparatus according to a third exemplary embodiment of the invention.

FIGS. 1 to 3 are sectional views schematically illustrating image holding members for an image forming apparatus according to first to third exemplary embodiments of the invention.

Each of the drawings is obtained by sectioning the image holding member 1 for an image forming apparatus in the layering direction of a conductive substrate 2 and a photosensitive layer 3.

The image holding member 1 for an image forming apparatus according to each of the first and second exemplary embodiments shown in FIGS. 1 and 2 includes a function-separated photosensitive layer in which a charge generation material and a charge transport material are contained in different layers. That is, in the photosensitive layer 3, a layer (charge generation layer 5) containing the charge generation material and a layer (charge transport layer 6) containing the charge transport material are separately formed and are layered to be adjacent to each other.

On the other hand, the image holding member 1 for an image forming apparatus according to the third exemplary embodiment shown in FIG. 3 includes a single-layered photosensitive layer in which the charge generation material and the charge transport material are contained in the same layer. That is, in the photosensitive layer 3, a charge generation and transport layer 8 containing the charge generation material and the charge transport material is formed.

More specifically, in the image holding member 1 for an image forming apparatus according to the first exemplary embodiment, an undercoating layer 4, a charge generation layer 5, and a charge transport layer 6 are sequentially stacked on a conductive substrate 2 to form a photosensitive layer 3. In the image holding member 1 for an image forming apparatus according to the second exemplary embodiment, an undercoating layer 4, a charge generation layer 5, a charge transport layer 6, and an overcoat layer 7 are sequentially stacked on a conductive substrate 2 to form a photosensitive layer 3. In the image holding member 1 for an image forming apparatus according to the third exemplary embodiment, an undercoating layer 4 and a charge generation and transport layer 8 are sequentially stacked on a conductive substrate 2 to form a photosensitive layer 3.

Although not shown in the drawings, a modified embodiment of the second exemplary embodiment is an embodiment in which the charge generation layer 5 and the charge transport layer 6 in the second exemplary embodiment are reversely stacked, and a modified embodiment of the third exemplary embodiment is an embodiment in which an overcoat layer 7 containing components used in the second exemplary embodiment is formed on the charge generation and transport layer 8 in the third exemplary embodiment.

The conductive substrate 2 may be formed of aluminum in a drum shape, a sheet shape, or a plate shape, but is not limited thereto. The conductive substrate 2 may be subjected to anodization treatment, Boehmite treatment, or honing treatment.

The undercoating layer 4 is disposed in an area between the conductive substrate 2 and the photosensitive layer 3 or an area between the conductive substrate 2 and the charge generation and transport layer 8, as shown in FIGS. 1 to 3. Examples of the material of the undercoating layer 4 include organic zirconium compounds such as a zirconium chelate compound, a zirconium alkoxide compound, or a zirconium coupling agent; organic titanium compounds such as a titanium chelate compound, a titanium alkoxide compound, or a titanate coupling agent; organic aluminum compounds such as an aluminum chelate compound or an aluminum coupling agent; and organic metal compounds such as an antimony alkoxide compound, a germanium alkoxide compound, an indium alkoxide compound, an indium chelate compound, a manganese alkoxide compound, a manganese chelate compound, a tin alkoxide compound, a tin chelate compound, an aluminum silicon alkoxide compound, an aluminum titanium alkoxide compound, or an aluminum zirconium alkoxide compound. Particularly, the organic zirconium compound, the organic titanium compound, or the organic aluminum compound may be used.

Silane coupling agents such as vinyl trichloro silane, vinyl trimethoxy silane, vinyl triethoxy silane, vinyl tris-2-methoxyethoxy silane, vinyl triacetoxy silane, γ-glycidoxypropyl trimethoxy silane, γ-methacryloxypropyl trimethoxy silane, γ-aminopropyl triethoxy silane, γ-chloropropyl trimethoxy silane, γ-2-aminoethylaminoproply trimethoxy silane, γ-mercaptopropyl trimethoxy silane, γ-ureidopropyl triethoxy silane, or β-3,4-epoxy cyclohexyl trimethoxy silane may be added thereto.

Known binder resins such as polyvinyl alcohol, polyvinylmethyl ether, poly-N-vinyl imidazole, polyethylene oxide, ethyl cellulose, methyl cellulose, an ethylene-acrylic acid copolymer, polyamide, polyimide, casein, gelatin, polyethylene, polyester, a phenol resin, a vinylchloride-vinylacetate copolymer, an epoxy resin, polyvinyl pyrolidone, polyvinyl pyridine, polyurethane, polyglutamic acid, or polyacrylic acid may be added thereto. The mixture ratio is set as needed.

In the undercoating layer 4, an electron transporting pigment may be mixed or dispersed therein for use.

Organic pigments such as a perylene pigment, a bisbenzimidazole perylene pigment, a polycyclic quinine pigment, an indigo pigment, or a quinacridone pigment which are described in Japanese Patent Application Laid-open (JP-A) No. 47-30330 may be used as the electron transporting pigment. Organic pigments such as a bisazo pigment or a phthalocyanine pigment having an electron attracting substituent group such as a cyano group, a nitro group, a nitroso group, or a halogen atom, and inorganic pigments such as zinc oxide or titanium oxide may be also used. Among the pigments, the perylene pigment, the bisbenzimidazole perylene pigment, the polycyclic quinine pigment, the zinc oxide, and the titanium oxide may be used.

The surface of the pigments may be treated with the coupling agent or the binder. The content of the electron transporting pigment is 95% by weight or less with respect to the total weight of the undercoating layer 4, or may be 90% by weight or less.

Normal methods using a ball mill, a roll mill, a sand mill, an attritor, or ultrasonic waves are used as a method of mixing or dispersing the electron transporting pigment in the undercoating layer 4. The mixing and dispersion is carried out in an organic solvent. The organic solvent is not particularly limited, as long as it may dissolve organic metal compounds or resins and does not cause gelation or aggregation when the electron transporting pigment is mixed or dispersed therein.

The thickness of the undercoating layer 4 may be in the range of from 0.1 μm to 30 μm or in the range of from 0.2 μm to 25 μm.

Normal methods such as a blade coating method, a wire bar coating method, a spray coating method, a dip coating method, a bead coating method, an air knife coating method, or a curtain coating method may be used as a coating method used to form the undercoating layer 4.

The coated layer formed by applying an undercoating layer forming composition containing the components is dried to obtain the undercoating layer 4. The drying is performed at a temperature at which a solvent may be evaporated to form a film. Particularly, a substrate having been subjected to an acid solution treatment or a Boehmite treatment may be insufficient in defect hiding power and thus the undercoating layer 4 may be formed.

Azo pigments such as bisazo or trisazo; condensed aromatic pigments such as dibromoanthanthrone; and existing pigments such as a perylene pigment, a pyrrolopyrrole pigment, or a phthalocyanine pigment may be used as the charge generation material contained in the charge generation layer 5, and metal and nonmetal phthalocyanine pigments may be used. Among these, hydroxy gallium phthalocyanine disclosed in Japanese Patent Application Laid-open (JP-A) Nos. 5-263007 and 5-279591, chloro gallium phthalocyanine disclosed in Japanese Patent Application Laid-open (JP-A) No. 5-98181, dichloro tin phthalocyanine disclosed in Japanese Patent Application Laid-open (JP-A) Nos. 5-140472 and 5-140473, and titanyl phthalocyanine disclosed in Japanese Patent Application Laid-open (JP-A) Nos. 4-189873 and 5-43813 may be used.

The charge generation layer 5 is formed by mixing a binder resin with a charge generation material. The binder resin is selected from various insulating resins and may be selected from organic photoconductive polymers such as poly-N-vinylcarbazole, polyvinyl anthracene, polyvinyl pyrene, or polysilane. Examples of the binder resin include insulating resins such as a polyvinyl butyral resin, a polyarylate resin (a polycondensation product of bisphenol A and phthalic acid), a polycarbonate resin, a polyester resin, a phenoxy resin, a vinylchloride-vinylacetate copolymer, a polyamide resin, an acryl resin, a polyacrylamide resin, a polyvinyl pyridine resin, a cellulose resin, an urethane resin, an epoxy resin, casein, a polyvinyl alcohol resin, or a polyvinyl pyrrolidone resin, but the binder resin is not limited to these examples. The binder resins may be used singly or in mixture of two or more kinds.

The insulating resin in the invention means an insulating resin of which the volume resistivity is $10^{12}$ Ωcm or more when it is measured on the basis of JIS K 7194 "Resistivity Test Method of Conductive Plastic using Four Probe Method".

The mixing ratio (weight ratio) of the charge generation material and the binder resin may be in the range of 10:1 to 1:10 or in the range of 8:3 to 3:8.

Normal methods such as a ball mill dispersion method, an attritor dispersion method or a sand mill dispersion method may be used as the method of dispersing the materials. At this time, the crystal type of the charge generation material should not be changed due to the dispersion. It is confirmed that the crystal type is not changed between before and after the dispersion process by any of the above dispersion methods used in the exemplary embodiment.

At the time of dispersion, the particle size of the charge generation material may be set to 0.5 μm or less, 0.3 μm or less, or 0.15 μm or less.

The thickness of the charge generation layer 5 may be in the range of from 0.1 μm to 5 μm or in the range of from 0.2 μm to 2.0 μm. Normal methods such as a blade coating method, a wire bar coating method, a spray coating method, a dip coating method, a bead coating method, an air knife coating method, or a curtain coating method may be used as a coating method used to form the charge generation layer 5.

The charge transport layer 6 may be formed by a known technique, except that it contains at least one of the compound represented by Formula (I) or the compound represented by Formula (II-1).

In addition to at least one of the compound represented by Formula (I) or the compound represented by Formula (II-1), the charge transport layer 6 may further contain other charge transport materials, binder resins, and the like. When the compound represented by Formula (I) is used but the compound represented by Formula (II-1) is not used, the compound represented by Formula (I) may be dispersed in the binder resin or the like for use. When the compound represented by Formula (II-1) is used, the charge transport layer 6 may be formed without using other resins, but other resins may be mixed therewith in view of low cost.

Examples of other charge transport materials include quinine compounds such as p-benzoquinone, chloranil, bromanil, or anthraquinone, fluorenone compounds such as a tetracyanoquinodimethane compound or 2,4,7-trinitrofluorenone, electron transporting compounds such as a xanthone compound, a benzophenone compound, a cyanovinyl compound, or an ethylene compound, and hole transporting compounds such as a triarylamine compound, a benzidine compound, an arylalkane compound, an aryl-substituted ethylene compound, a stilbene compound, an anthracene compound, or a hydrazine compound, but the charge transport material is not limited to these examples.

With respect to the total weight of the charge transport layer 6, the content of the compound represented by Formula (I) and the compound represented by Formula (II-1) may be in the range of from 5% by weight to 70% by weight (or from about 5% by weight to about 70% by weight), in the range of from 10% by weight to 60% by weight, or in the range of from 20% by weight to 50% by weight.

When a compound other than the compound represented by Formula (I) and the compound represented by Formula (II-1) is also used as the charge transport material, the content of the compound represented by Formula (I) and the compound represented by Formula (II-1) may be in the range of 1% by weight or more with respect to the total weight of the charge transport material, or may be 5% by weight or more.

When a binder resin is used in the charge transport layer 6, examples of the binder resin include a polycarbonate resin, a polyester resin, a methacryl resin, an acryl resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, poly-N-vinylcarbazole, polysilane, and polymer charge transport materials such as a polyester polymer charge transport material disclosed in Japanese Patent Application Laid-open (JP-A) Nos. 8-176293 and 8-208820. The binder resins may be used singly or in combination of two or more kinds. The mixing ratio (weight ratio) of the charge transport material and the binder resin may be in the range of 10:1 to 1:10 or in the range of 8:3 to 3:8.

The thickness of the charge transport layer 6 may be in the range of from 5 μm to 50 μm or in the range of from 10 μm to 30 μm.

Normal methods such as a blade coating method, a wire bar coating method, a spray coating method, a dip coating method, a bead coating method, an air knife coating method, or a curtain coating method may be used as the coating method.

Additives such as an antioxidant, a light stabilizer, or a thermal stabilizer may be added to the photosensitive layer. The photosensitive layer may contain at least one kind of electron-accepting material.

The image holding member for an image forming apparatus according to the exemplary embodiment may include an overcoat layer 7 (surface layer), and the overcoat layer 7 may be a high-strength overcoat layer (high-strength surface layer). A material in which conductive particles are dispersed in a binder resin, a material in which lubricant particles of a fluorine resin or an acryl resin are dispersed in a normal charge transporting layer material, or a hard coating agent such as silicone or acryl resin is used in the high-strength overcoat layer. The high-strength overcoat layer may contain a siloxane resin having a charge transport property and a cross-linked structure.

The overcoat layer 7 may include a mixture of other coupling agents and fluorine compounds. Various silane coupling agents and silicone hard coating agents available from the market are used as the compounds.

The preparation of the coating liquid used to form the overcoat layer 7 may be performed without using a solvent or may be performed using a solvent as needed.

The reaction temperature varies depending on the kinds of the materials, but is generally in the range of from 0° C. to 100° C., or may be in the range of from 10° C. to 70° C., or in the range of from 15° C. to 50° C. The reaction time is not particularly limited, but may be in the range of 10 minutes to 100 hours.

Examples of a curing catalyst include protonic acids such as a hydrochloric acid, an acetic acid, a phosphoric acid, or a sulfuric acid, bases such as ammonia or triethylamine, organic tin compounds such as dibutyl tin diacetate, dibutyl tin dioctoate, or stannous octoate, organic titanium compounds such as tetra-n-butyl titanate or tetraisopropyl titanate, organic aluminum compounds such as aluminum tributoxide or aluminum triacetyl acetonate, and an iron salt, a manganese salt, a cobalt salt, a zinc salt, and a zirconium salt of organic carboxylic acid. Among these, the metal compounds, acetylacetonate of metal, or acetylacetate may be used, and aluminum triacetylacetonate may be used.

The amount of curing catalyst to be used is set as needed, and may be in the range of from 0.1% by weight to 20% by weight with respect to the total weight of the materials containing a hydrolytic silicon substituent group, or may be in the range of from 0.3% by weight to 10% by weight.

The curing temperature is set as needed, and may be set to 60° C. or higher, or 80° C. or higher, to obtain a desired strength. The curing time is set as needed, and may be in the range of 10 minutes to 5 hours.

It is effective that a high-humidity state is maintained after the curing reaction. For some application, a surface treatment using hexamethyl disilazane or trimethyl chlorosilane is carried out to hydrophobize the surface.

An antioxidant may be added to the overcoat layer 7 of the image holding member for an image forming apparatus.

A resin which is dissolved in alcohol may be added to the overcoat layer 7 of the image holding member for an image forming apparatus.

Various particles may be added to the overcoat layer 7. The particles may be used singly or in combinations. Examples of the particles include silicon-containing particles, fluorine-containing particles, and semi-conductive metal oxide particles.

Oil such as silicone oil may be added to the overcoat layer 7.

In case of the single-layered photosensitive layer, the single-layered photosensitive layer may be formed of the charge generation material, the charge transport material (including at least one of the compound represented by Formula (I) or the compound represented by Formula (II-1) according to the exemplary embodiment), and the binder resin. The charge transport material may contain a polymer charge transfer material. The examples described above as the binder resin used for the charge generation layer 5 and the charge transport layer 6 are used as the binder resin. The content of the charge generation material in the single-layered photosensitive layer may be in the range of from 10% by weight to 85% by weight or in the range of from 20% by weight to 50% by weight. The content of the charge transport material in the single-layered photosensitive layer may be in the range of from 5% by weight to 50% by weight.

The solvent and the coating method used in the coating are as described above. The thickness of the single-layered photosensitive layer may be in the range of from 5 μm to 50 μm or in the range of from 10 μm to 40 μm.

(Image Forming Apparatus)

An image forming apparatus according to the exemplary embodiment includes the image holding member for an image forming apparatus according to the exemplary embodiment, a charging device that charges the image holding member for an image forming apparatus, an exposing device that exposes the charged image holding member for an image forming apparatus to form an electrostatic latent image, a developing device that develops the electrostatic latent image to form a toner image, and a transfer device that transfers the toner image onto a recording medium.

Figure 4:
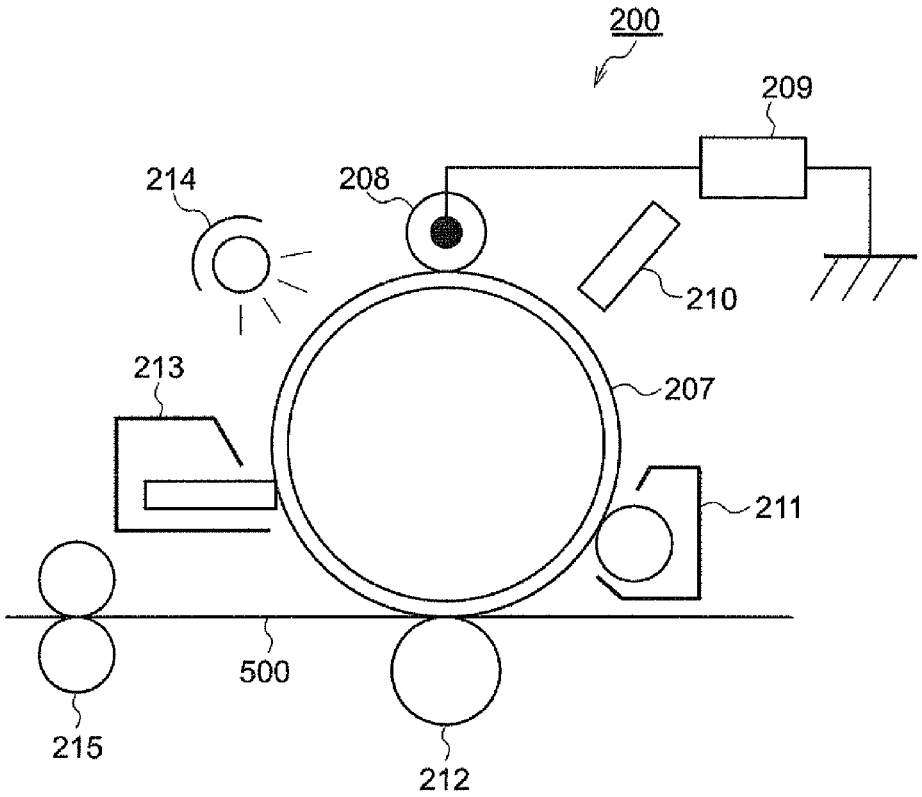
FIG. 4 is a diagram schematically illustrating the configuration of an image forming apparatus according to an exemplary embodiment of the invention.

FIG. 4 is a sectional view schematically illustrating the basic configuration of an image forming apparatus according to the exemplary embodiment.

The image forming apparatus 200 shown in FIG. 4 includes an image holding member 207 for an image forming apparatus according to the exemplary embodiment, a charging device 208 that charges the image holding member 207 for an image forming apparatus in a contact-charging manner, a power source 209 connected to the charging device 208, an exposing device 210 that exposes the image holding member 207 for an image forming apparatus charged by the charging device 208 to form an electrostatic latent image, a developing device 211 that develops the electrostatic latent image formed by the exposing device 210 with a toner to form a toner image, a transfer device 212 that transfers the toner image formed by the developing device 211 onto a recording medium 500, a cleaning device 213, an eraser 214, and a fixing device 215.

The charging device 208 shown in FIG. 4 applies a voltage to the image holding member to charge the surface of the image holding member by bringing a contact charging member (such as a charging roll) into contact with the surface of the image holding member 207 for an image forming apparatus.

A roller-like member in which an elastic layer, a resistive layer, and a protective layer are formed on the outer circumferential surface of a core may be used as the contact charging member. The shape of the contact charging member may be any of a brush shape, a blade shape, and a pin electrode shape, in addition to the roller shape, and is selected depending on the specification or the type of the image forming apparatus.

The core of the roller-like contact charging member may be formed of a material having conductivity such as iron, copper, brass, stainless steel, aluminum, or nickel. A resin-molded product in which conductive particles are dispersed or the like may also be used. The elastic layer is formed of a material having conductivity or semi-conductivity such as a material in which conductive particles or semi-conductive particles are dispersed in a rubber material. The resistive layer and the protective layer are formed of a material in which conductive particles or semi-conductive particles are dispersed in a binder resin to control the resistance.

At the time of charging the image holding member using the contact charging member, a voltage is applied to the contact charging member. The applied voltage may be any of a DC voltage and a voltage in which an AC voltage is superposed on a DC voltage.

Instead of the contact charging member in FIG. 4, non-contact corona charging devices such as corotron or scorotron are also used. These charging devices are selected depending on the specification or the type of the image forming apparatus.

An optical device that exposes the surface of the image holding member for an image forming apparatus with a light source such as a semiconductor laser, an LED (light emitting diode), or a liquid crystal shutter to form a desired image is used as the exposing device 210.

A known developing devices using a single-component or two-component, regular or reversal developer is used as the developing device 211. The shape of the toner used in the developing device 211 is not particularly limited, but a spherical toner may be used.

Examples of the transfer device 212 include a contact transfer charger using a belt, a film, or a rubber blade, and a scorotron transfer charger or a corotron transfer charger using corona discharge, in addition to the roller-like contact charging member.

The cleaning device 213 serves to remove a residual toner attached to the surface of the image holding member for an image forming apparatus after the transfer process. Accordingly, the image holding member for an image forming apparatus cleaned by the cleaning device is repeatedly subjected to the image forming process. A brush cleaning and a roll cleaning in addition to the cleaning blade are used as the cleaning device, and the cleaning blade may be used. Examples of the material of the cleaning blade include urethane rubber, neoprene rubber, and silicone rubber.

In the above-mentioned embodiment, the image forming apparatus includes a single image forming unit. In another embodiment, the image forming apparatus is a tandem type image forming apparatus including plural image forming units.

For example, when the number of image forming units is 4, the developing devices of four image forming units use four color-component toners of, for example, yellow, magenta, cyan, and black, respectively. The tandem type image forming apparatus may include a belt for carrying a recording medium, a carrying device for carrying the belt, a toner supply device for supplying toners to the developing devices, and a fixing device for fixing color toner images onto the recording medium, which are common to four image forming units.

When the image holding member is used by 200,000 cycles or more, 250,000 cycles or more, or 300,000 cycles or more, the image forming apparatus according to the exemplary embodiment may include a separate mechanism only for replenishing the toner.

(Process Cartridge)

The process cartridge according to the exemplary embodiment includes at least the image holding member for an image forming apparatus according to the exemplary embodiment of the invention, and further includes at least one selected from a charging device that charges the image holding member for an image forming apparatus, an exposing device that expose the charged image holding member for an image forming apparatus to form an electrostatic latent image, a developing device that develops the electrostatic latent image to form a toner image, a transfer device that transfers the toner image onto a recording medium, and a cleaning device that cleans the image holding member for an image forming apparatus.

Figure 5:
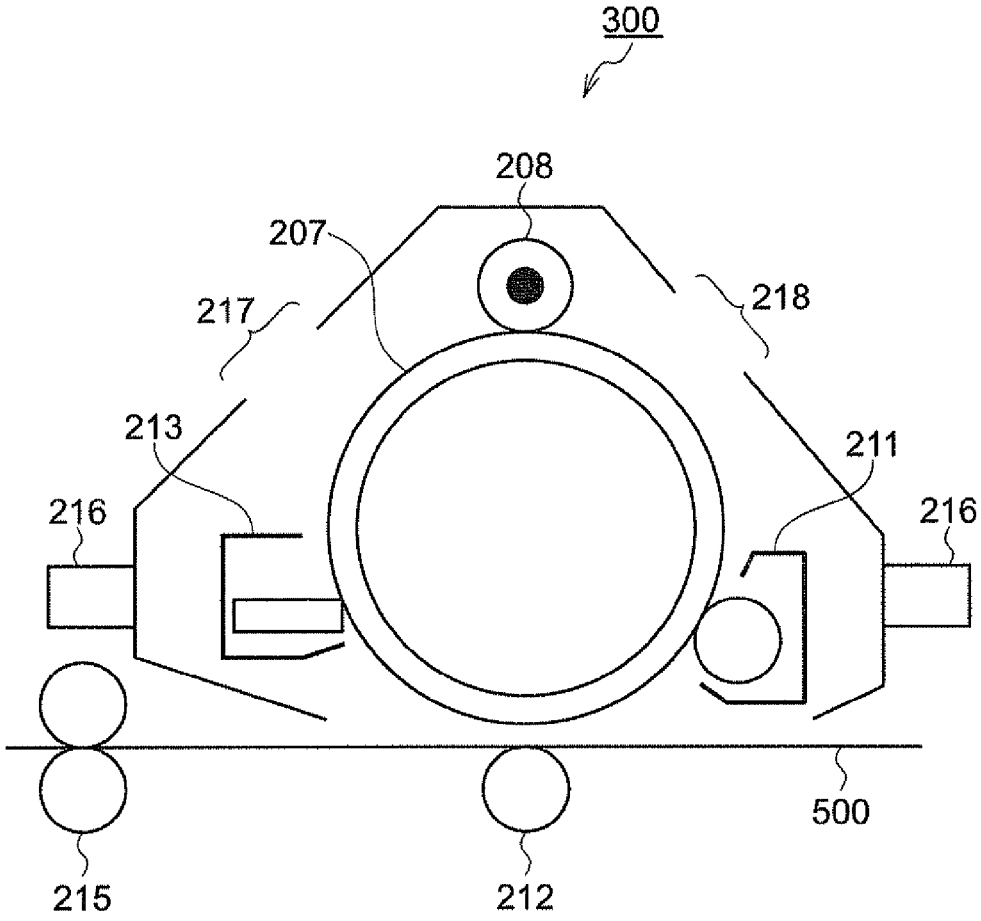
FIG. 5 is a diagram schematically illustrating the configuration of a process cartridge according to an exemplary embodiment of the invention.

FIG. 5 is a sectional view schematically illustrating the basic configuration of a process cartridge including the image holding member for an image forming apparatus according to the exemplary embodiment.

The process cartridge 300 includes an image holding member 207 for an image forming apparatus, a charging device 208, a developing device 211, a cleaning device (cleaning unit) 213, an exposure opening 218, and an erasing exposure opening 217, which are combined into a body using a mounting rail 216.

The process cartridge 300 is attachable to and detachable from an image forming apparatus main body including a transfer device 212 that transfers the toner image formed by the developing device 211 to a recording medium 500, a fixing device 215, and other elements not shown in the drawings, and forms an image forming apparatus in cooperation with the image forming apparatus main body.

While the embodiments have been described, the embodiments may also be modified in various forms.

EXAMPLES

The invention will be described below with reference to examples, but the invention is not limited to the examples.

In the examples, a $^1$H-NMR spectrum (solvent: $CDCl_3$, UNITY-300, made by Varian Inc., 300 Hz) and an IR spectrum (Fourier transform infrared spectrophotometer (FT-730, made by Horiba Ltd., resolution: 4 $cm^{-1}$) in a KBr method) are used to identify the target product.

In the examples, the molecular weight of a polymer is measured by gel permeation chromatography (GPC) (HLC-8120 GPC, made by Tosoh Corporation).

(Synthesis of Compound Represented by Formula (I) or (II-1))

Synthesis Example 1

Synthesis of Specific Example Compound (4)

Acetanilide (25.0 g), methyl 4-iodophenyl propionate (64.4 g), potassium carbonate (38.3 g), copper sulfate pentahydrate (2.3 g), and n-tridecane (50 mL) are introduced into a 500 mL three-necked flask, and the resultant is heated and stirred in a nitrogen stream at 230° C. for 20 hours. After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized with a hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours. After the reaction, the resultant is extracted with toluene and the organic phase is washed with pure water. Then, the resultant is dried with sodium sulfate anhydride, the solvent is distilled under a depressurized condition, and the resultant is re-crystallized in hexane, whereby 36.5 g of DAA-1 is obtained.

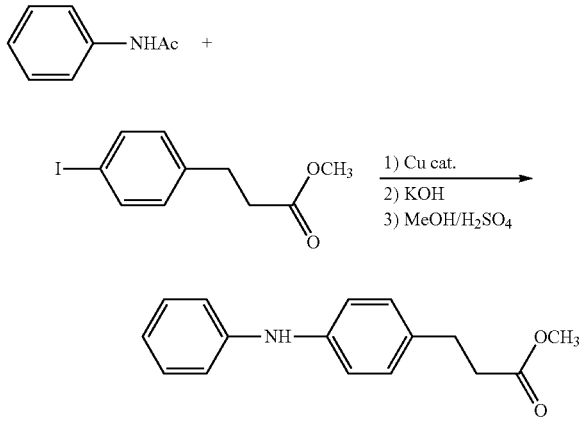

DAA-1

A mixed solution of iodobenzene (4.8 g), the DAA-1 (5.0 g), copper sulfate (II) pentahydrate (0.2 g), potassium carbonate (1.3 g), and tridecane (10 mL) is stirred at 210° C. for 7 hours. After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized with a hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours. The resultant is cooled at a room temperature (25° C.), toluene is added thereto, and then the resultant is filtrated with celite. The resultant is washed with pure water, the organic phase is extracted, the organic solvent is distilled, and the obtained product is separated with a silica gel column chromatograph (hexane 4: toluene 1), whereby 3.9 g of TAA-1 is obtained.

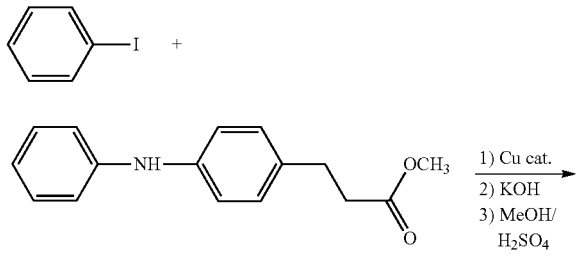

DAA-1

-continued

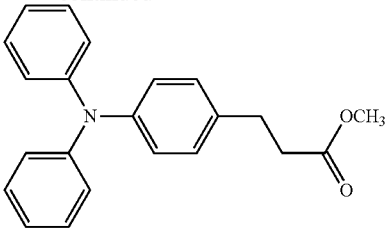

TAA-1

A mixed solution of TAA-1 (3.0 g) and N,N-dimethyl formamide (100 mL) is introduced into a 500 mL three-necked flask, phosphorous oxychloride (1.7 g) is dropped thereto, and the resultant is heated to 80° C. and is stirred for 7 hours.

After the cooling, a reaction solution is added to pure water and the precipitated crystals are taken by sucking filtration, whereby 2.4 g of a formylated product of TAA-1 is obtained.

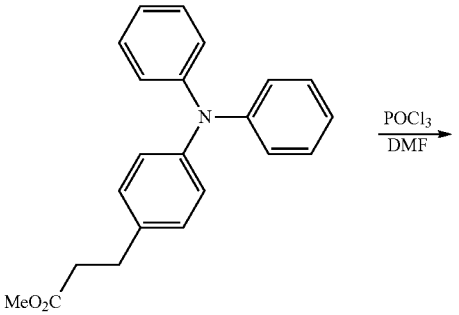

TAA-1

-continued

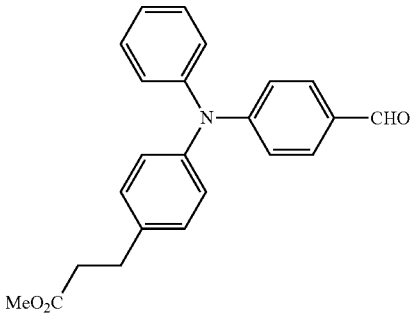

Formylated Product of TAA-1

In the atmosphere of nitrogen, the formylated product of TAA-1 (2.0 g) and rubeanic acid (0.37 g) are dissolved in mesitylene (5 mL) and the resultant is made to reflux for 30 hours. Solid obtained by distilling mesitylene under a depressurized condition is extracted with hexane by the use of a Soxhlet extractor (6 hours) to remove impurities. Then, the Soxhlet extraction is carried out with toluene (for 4.5 hours), the obtained crude crystals are separated by the silica gel column chromatography (toluene:ethylacetate=20:1), the resultant is re-crystallized in toluene, whereby 0.62 g of specific example compound (4) is obtained.

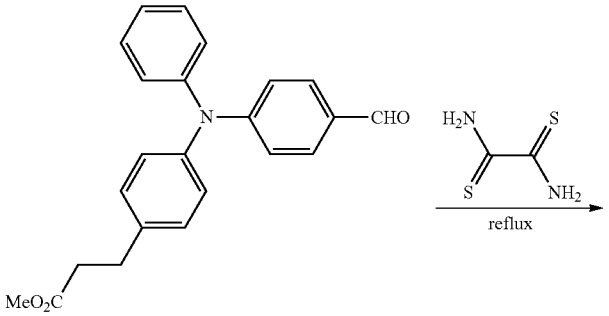

Formylated Product of TAA-1

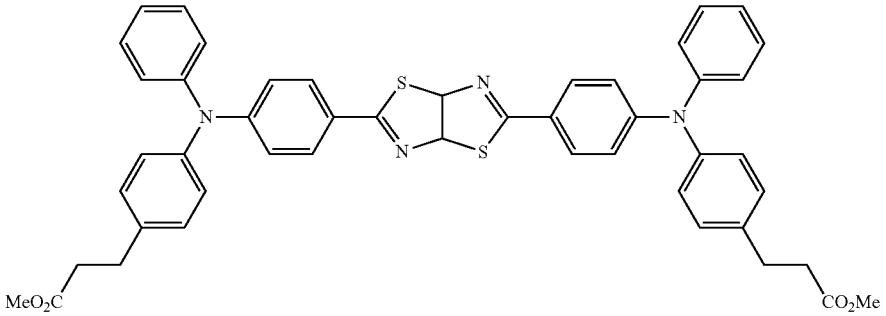

Specific Example Compound (4)

The melting point of specific example compound (4) is in the range of 191° C. to 192° C. By the $^1$H-NMR spectrum measurement and the IR spectrum measurement, it is confirmed that the obtained compound is specific example compound (4).

Synthesis Example 2

Synthesis of Specific Example Polymer 6

1.0 g of specific example compound (4) obtained in Synthesis Example 1, 10 mL of ethylene glycol, and 0.02 g of titanium tetrabutoxide are introduced into a 50 mL three-necked recovery flask and the resultant is heated and stirred in the atmosphere of nitrogen at 200° C. for 5 hours.

After it is confirmed by TLC that specific example compound (4) as a raw material is consumed by reaction, the flask is depressurized to 50 Pa, the resultant is heated to 210° C. while distilling ethylene glycol, and the reaction is continuously performed in this state for 6 hours.

Thereafter, the resultant is cooled to a room temperature (25° C.) and is dissolved in 50 mL of tetrahydrofuran, the insoluble materials are filtrated with a 0.5 μL. polytetrafluoroethylene (PTFE) filter, the filtrate is distilled under a depressurized condition, the resultant is dissolved in 300 mL of monochlorobenzene, and the resultant is washed sequentially with 300 mL of 1N-HCl and 500 mL×3 of water. The monochlorobenzene solution is distilled to 30 mL under a depressurized condition and is dropped into ethylacetate/methanol=1/3:800 mL, and a polymer is re-precipitated.

The obtained polymer is filtrated, is washed with methanol, and is dried in vacuum at 60° C. for 16 hours, whereby 0.7 g of polymer (specific example polymer 6) is obtained.

The molecular weight of the polymer is measured by the gel permeation chromatography (GPC) (HLC-8120 GPC, made by Tosoh Corporation) and the result is as follows. Mw=6.0×10$^4$ (in terms of polystyrene), Mw/Mn=1.82, and the degree of polymerization p calculated from the molecular weight of a low molecular-weight compound as a raw material is 75.

Synthesis Example 3

Synthesis of Specific Example Compound (23)

4-(2-thienyl) acetanilide (30.0 g), methyl 4-iodophenyl propionate (28.5 g), potassium carbonate (13.6 g), copper sulfate pentahydrate (2.0 g), and 1,2-dichlorobenzene (50 mL) are introduced into a 500 mL three-necked flask, and the resultant is heated and stirred in a nitrogen stream at 230° C. for 20 hours. After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized with a hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours. After the reaction, the resultant is extracted with toluene and the organic phase is washed with pure water. Then, the resultant is dried with sodium sulfate anhydride, the solvent is distilled under a depressurized condition, and the resultant is re-crystallized in hexane, whereby 17.9 g of DAA-2 is obtained.

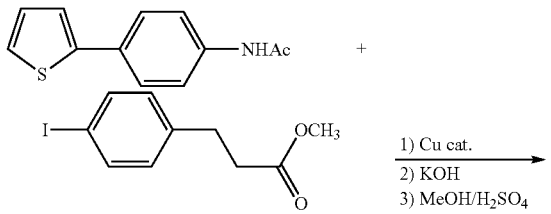

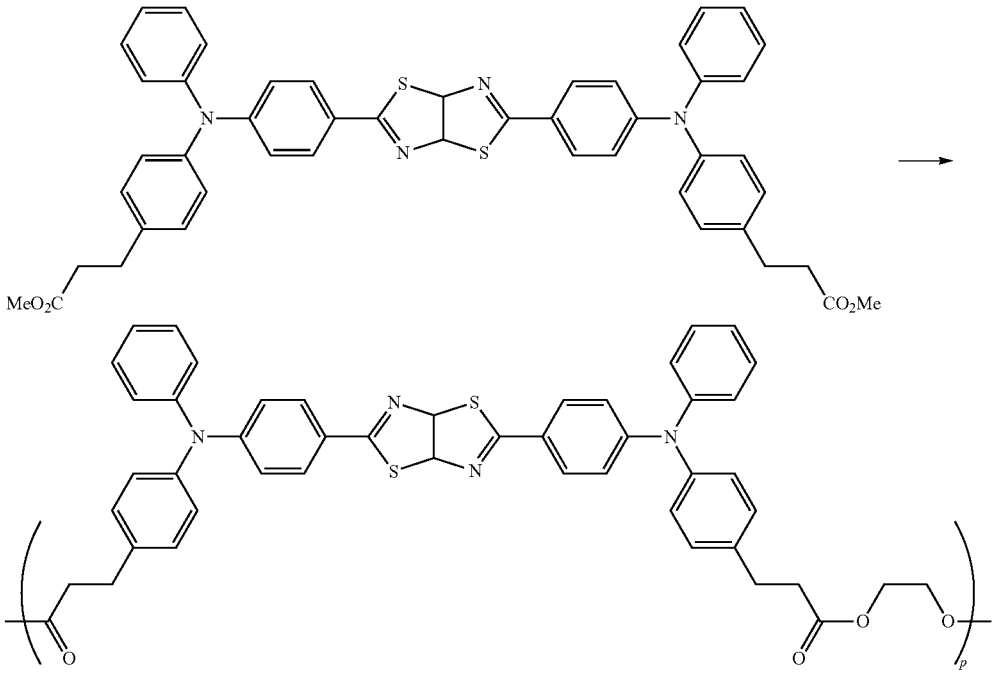

-continued

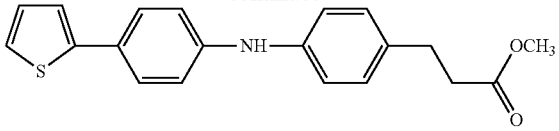

DAA-2

In the atmosphere of nitrogen, a mixed solution of iodobenzene (3.6 g), DAA-2 (5.0 g), copper sulfate (II) pentahydrate (0.2 g), potassium carbonate (1.3 g), and tridecane (15 mL) is stirred at 210° C. for 15 hours.

After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized with a hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours.

After the cooling, toluene is added to the resultant, then the resultant is filtrated with celite, toluene is distilled, and the obtained product is separated with a silica gel column chromatograph (hexane 2: toluene 1), whereby 3.2 g of TAA-2 is obtained.

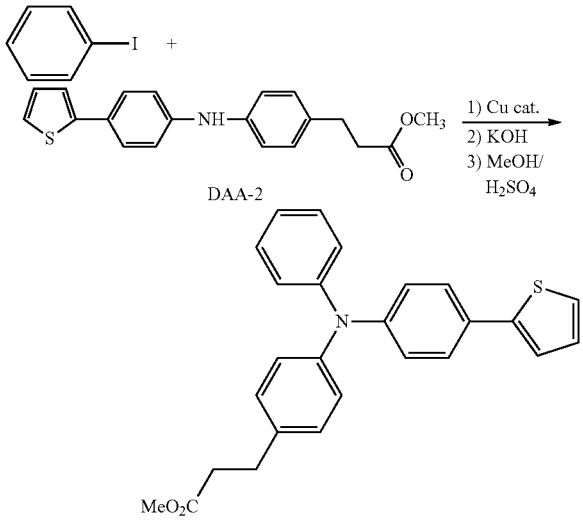

DAA-2

TAA-2

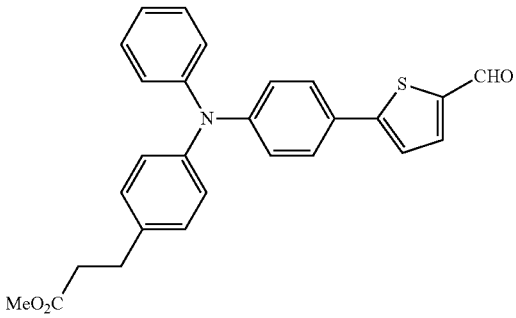

Formylated Product of TAA-2

TAA-2 (3.0 g) is dissolved in N,N-dimethyl formamide (5 mL) and phosphorous oxychloride is dropped thereto. The resultant is stirred at a room temperature (25° C.) for 4 hours, N,N-dimethyl formamide anhydride (3 mL) is further added thereto, and the resultant is magnetically stirred for 13.5 hours. After the end of the reaction, water (100 mL) and ethylacetate (100 mL) are added thereto and stirred, the organic phase is separated, and the organic phase is washed with 50 mL of saturated saline and is dried with sodium sulfate. The crude product obtained by distilled the solvent is separated by the silica gel column chromatography (ethylacetate:hexane=1:4), whereby 2.5 g of a formylated product of TAA-2 is obtained.

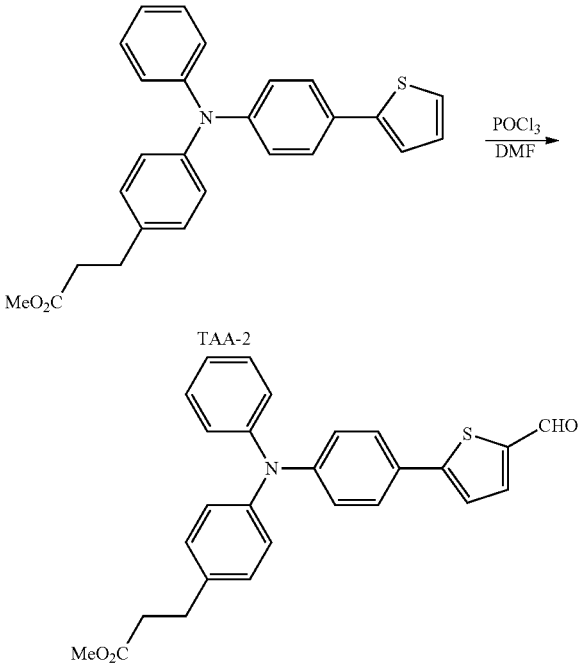

Formylated Product of TAA-2

The formylated product of TAA-2 (2.2 g) and rubeanic acid (0.37 g) are dissolved in mesitylene (5 mL) and the resultant is made to reflux for 30 hours. Solid obtained by distilling mesitylene under a depressurized condition is extracted with hexane by the use of a Soxhlet extractor (6 hours) to remove impurities. Then, the obtained crude crystals are separated by the silica gel column chromatography (toluene:ethylacetate=20:1), the resultant is re-crystallized in toluene, whereby 0.54 g of specific example compound (23) is obtained.

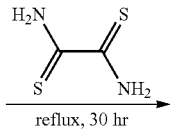

-continued

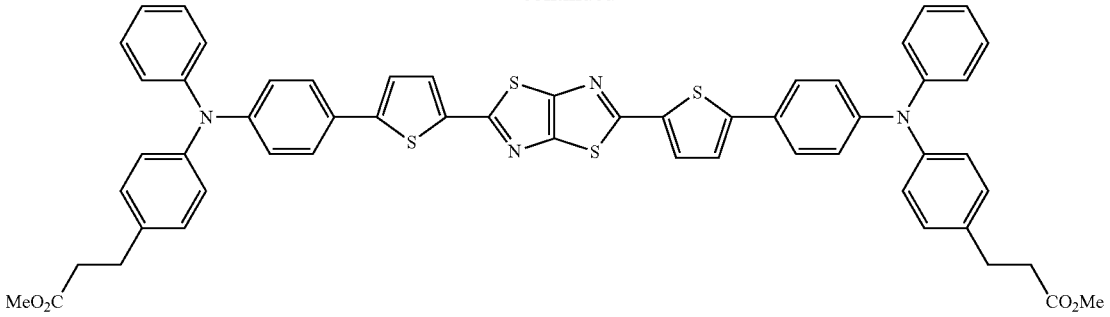

Specific Example Compound (23)

The melting point of specific example compound (23) is in the range of 227° C. to 228° C. By the $^1$H-NMR spectrum measurement and the IR spectrum measurement, it is confirmed that the obtained compound is specific example compound (23).

Synthesis Example 4

Synthesis of Specific Example Polymer 21

1.0 g of specific example compound (23) obtained in Synthesis Example 3, 10 mL of ethylene glycol, and 0.02 g of titanium tetrabutoxide are introduced into a 50 mL three-necked recovery flask and the resultant is heated and stirred in the atmosphere of nitrogen at 200° C. for 5 hours.

After it is confirmed by TLC that specific example compound (23) as a raw material is consumed by reaction, the flask is depressurized to 50 Pa, the resultant is heated to 210° C. while distilling ethylene glycol, and the reaction is continuously performed in this state for 6 hours.

Thereafter, the resultant is cooled to a room temperature (25° C.) and is dissolved in 50 mL of tetrahydrofuran, the insoluble materials are filtrated with a 0.5 μL polytetrafluoroethylene (PTFE) filter, the filtrate is distilled under a depressurized condition, the resultant is dissolved in 300 mL of monochlorobenzene, and the resultant is washed sequentially with 300 mL of 1N-HCl and 500 mL×3 of water. The monochlorobenzene solution is distilled to 30 mL under a depressurized condition and is dropped into ethylacetate/methanol=1/3:800 mL, and a polymer is re-precipitated.

The obtained polymer is filtrated, is washed with methanol, and is dried in vacuum at 60° C. for 16 hours, whereby 0.7 g of polymer (specific example polymer 21) is obtained.

The molecular weight of the polymer is measured by the gel permeation chromatography (GPC) (HLC-8120 GPC, made by Tosoh Corporation) and the result is as follows. Mw=7.8×10$^4$ (in terms of polystyrene), Mw/Mn=2.01, and the degree of polymerization p calculated from the molecular weight of a low molecular-weight compound as a raw material is 81.

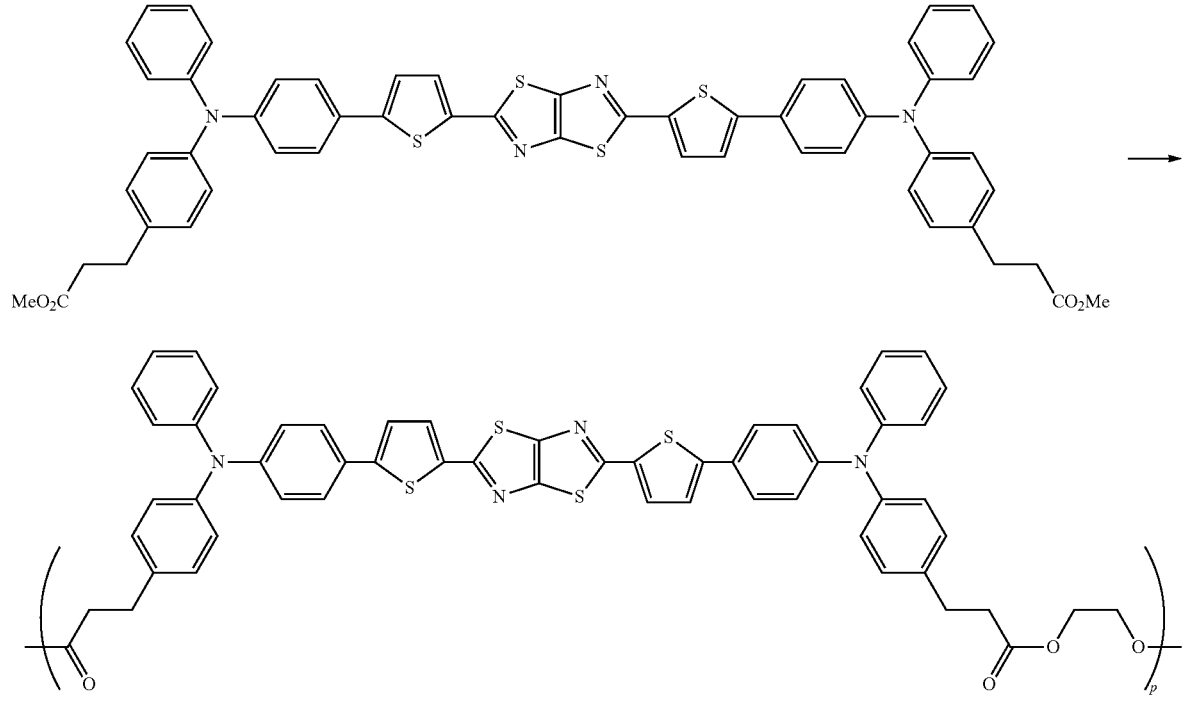

Synthesis Example 5

Synthesis of Specific Example Compound (5)

4-methyl acetanilide (21.0 g), methyl 4-iodophenyl propionate (64.4 g), potassium carbonate (38.3 g), copper sulfate pentahydrate (2.3 g), and n-tridecane (50 mL) are introduced into a 500 mL three-necked flask, and the resultant is heated and stirred in a nitrogen stream at 230° C. for 20 hours. After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized with a hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours. After the reaction, the resultant is extracted with toluene and the organic phase is washed with pure water. Then, the resultant is dried with sodium sulfate anhydride, the solvent is distilled under a depressurized condition, and the resultant is re-crystallized in hexane, whereby 34.1 g of DAA-3 is obtained.

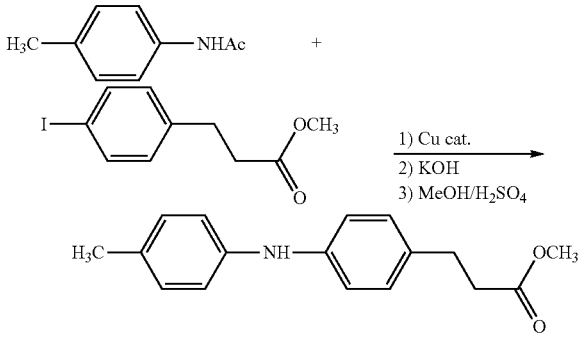

DAA-3

A mixed solution of iodobenzene (4.8 g), DAA-3 (5.0 g), copper sulfate (II) pentahydrate (0.2 g), potassium carbonate (1.3 g), and tridecane (10 mL) is stirred at 210° C. for 7 hours. After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized with a hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours, The resultant is cooled at a room temperature (25° C.), toluene is added thereto, and then the resultant is filtrated with celite. The resultant is washed with pure water, the organic phase is extracted, the organic solvent is distilled, and the obtained product is separated with a silica gel column chromatograph (hexane 4: toluene 1), whereby 3.1 g of TAA-3 is obtained.

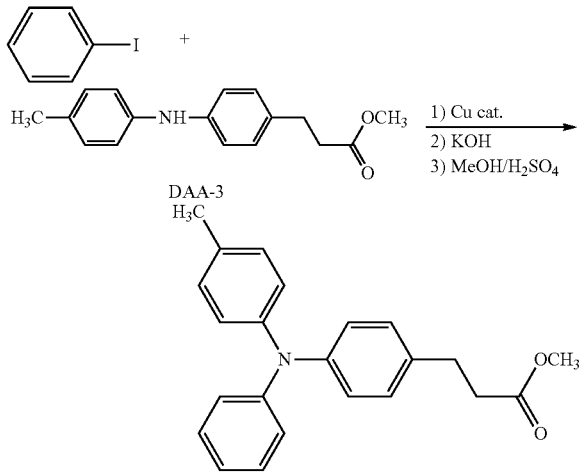

TAA-3

A mixed solution of TAA-3 (3.0 g) and N,N-dimethyl formamide (100 mL) is introduced into a 500 mL three-necked flask, phosphorous oxychloride (1.7 g) is dropped thereto, and the resultant is heated to 80° C. and is stirred for 7 hours.

After the cooling, a reaction solution is added to pure water and the precipitated crystals are taken by sucking filtration, whereby 2.4 g of a formylated product of TAA-3 is obtained.

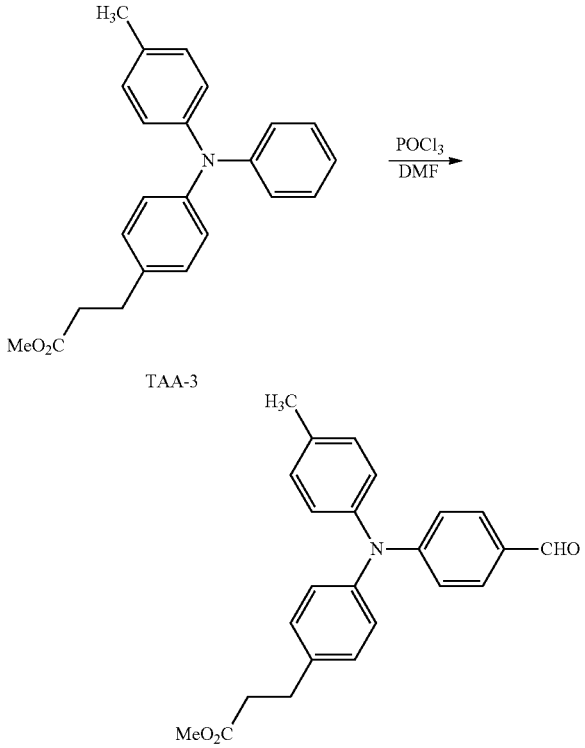

TAA-3

Formylated Product of TAA-3

In the atmosphere of nitrogen, the formylated product of TAA-3 (2.0 g) and rubeanic acid (0.37 g) are dissolved in mesitylene (5 mL) and the resultant is made to reflux for 30 hours. Solid obtained by distilling mesitylene under a depressurized condition is extracted with hexane by the use of a Soxhlet extractor (6 hours) to remove impurities. Then, the Soxhlet extraction is carried out with toluene (for 4.5 hours), the obtained crude crystals are separated by the silica gel column chromatography (toluene:ethylacetate=20:1), the resultant is re-crystallized in toluene, whereby 0.62 g of specific example compound (5) is obtained.

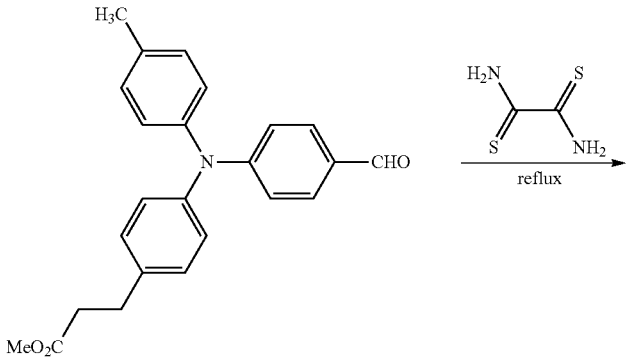

Formylated Product of TAA-3

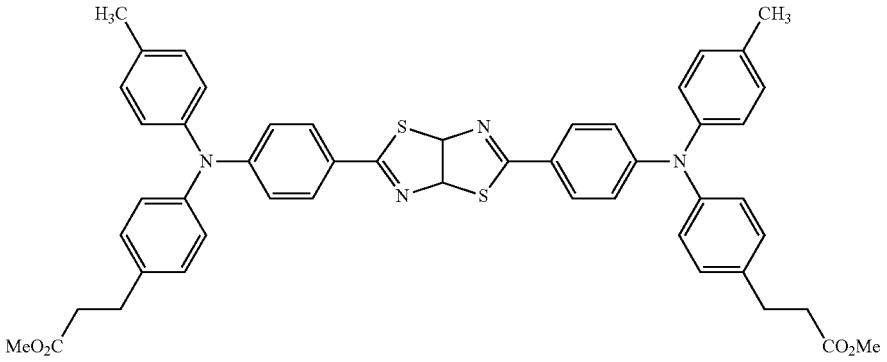

Specific Example Compound (5)

The melting point of specific example compound (5) is in the range of 198° C. to 201° C. By the $^1$H-NMR spectrum measurement and the IR spectrum measurement, it is confirmed that the obtained compound is specific example compound (5).

Synthesis Example 6

Synthesis of Specific Example Compound (25)

4-(2-thienyl) acetanilide (30.0 g), methyl 4-iodophenyl propionate (28.5 g), potassium carbonate (13.6 g), copper sulfate pentahydrate (2.0 g), and 1,2-dichlorobenzene (50 mL) are introduced into a 500 mL three-necked flask, and the resultant is heated and stirred in a nitrogen stream at 230° C. for 20 hours. After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized with hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours. After the reaction, the resultant is extracted with toluene and the organic phase is washed with pure water. Then, the resultant is dried with sodium sulfate anhydride, the solvent is distilled under a depressurized condition, and the resultant is re-crystallized in hexane, whereby 17.9 g of DAA-2 is obtained.

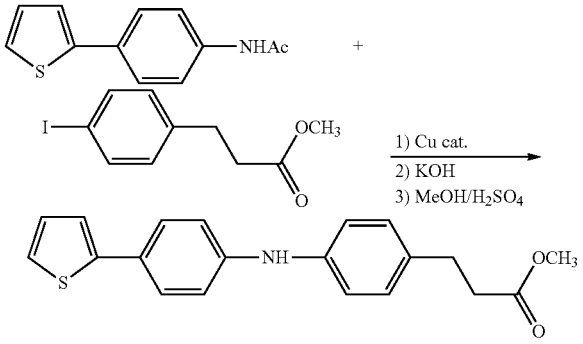

DAA-2

In the atmosphere of nitrogen, a mixed solution of 3-methyl iodobenzene (4.0 g), DAA-2 (5.0 g), copper sulfate (II) pentahydrate (0.2 g), potassium carbonate (1.3 g), and tridecane (15 mL) is stirred at 210° C. for 15 hours.

After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized with hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours.

After the cooling, toluene is added to the resultant, then the resultant is filtrated with celite, and the product obtained by removing toluene is separated with a silica gel column chromatograph (hexane 2: toluene 1), whereby 3.0 g of TAA-4 is obtained.

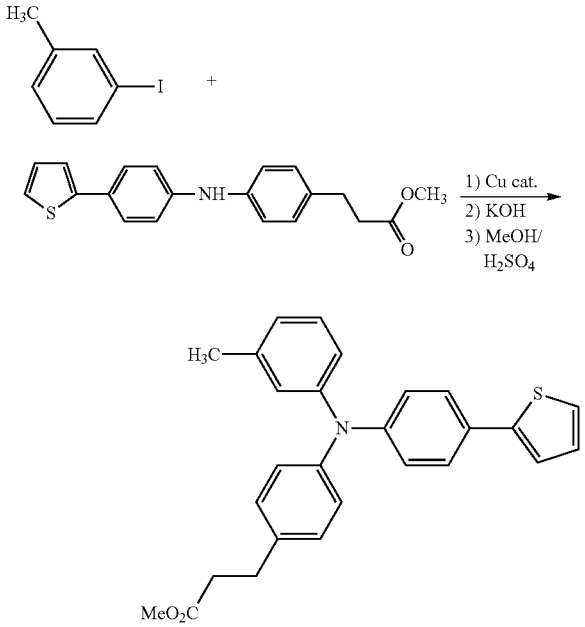

TAA-4

TAA-4 (3.0 g) is dissolved in N,N-dimethyl formamide (5 mL) and phosphorous oxychloride is dropped thereto. The resultant is stirred at a room temperature (25° C.) for 4 hours, N,N-dimethyl formamide anhydride (3 mL) is further added thereto, and the resultant is magnetically stirred for 13.5 hours. After the end of the reaction, water (100 mL) and ethylacetate (100 mL) are added thereto and stirred, the organic phase is separated, and the organic phase is washed with 50 mL of saturated saline and is dried with sodium sulfate. The crude product obtained by distilling the solvent is separated by the silica gel column chromatography (ethylacetate:hexane=1:4), whereby 2.5 g of a formylated product of TAA-4 is obtained.

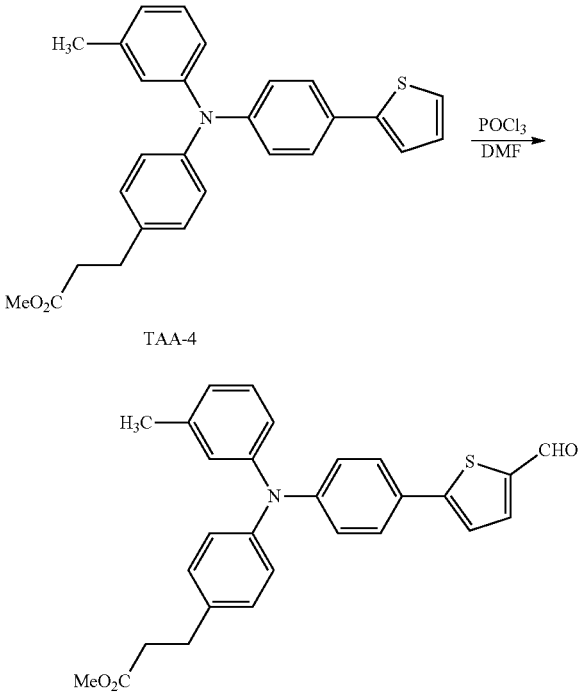

Formylated Product of TAA-4

The formylated product of TAA-4 (2.4 g) and rubeanic acid (0.37 g) are dissolved in mesitylene (5 mL) and the resultant is made to reflux for 30 hours. Solid obtained by distilling mesitylene under a depressurized condition is extracted with hexane by the use of a Soxhlet extractor (6 hours) to remove impurities. Then, the obtained crude crystals are separated by the silica gel column chromatography (toluene:ethylacetate=20:1), the resultant is re-crystallized in toluene, whereby 0.61 g of specific example compound (25) is obtained.

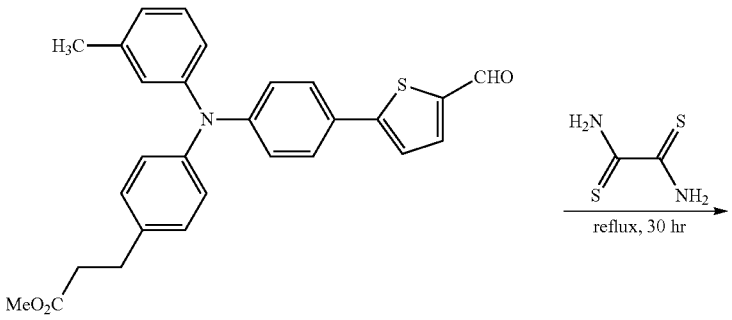

Formylated Product of TAA-4

-continued

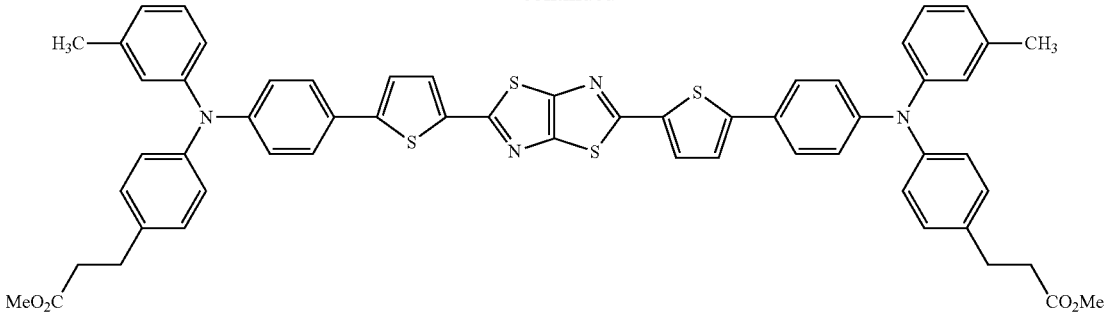

Specific Example Compound (25)

By the $^1$H-NMR spectrum measurement and the IR spectrum measurement, it is confirmed that the obtained compound is specific example compound (25).

Synthesis Example 7

Synthesis of Specific Example Compound (29)

4-(2-thienyl) acetanilide (30.0 g), methyl 4-iodophenyl propionate (28.5 g), potassium carbonate (13.6 g), copper sulfate pentahydrate (2.0 g), and 1,2-dichlorobenzene (50 mL) are introduced into a 500 mL three-necked flask, and the resultant is heated and stirred in a nitrogen stream at 230° C. for 20 hours. After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours. After the reaction, the resultant is extracted with toluene and the organic phase is washed with pure water. Then, the resultant is dried with sodium sulfate anhydride, the solvent is distilled under a depressurized condition, and the resultant is re-crystallized in hexane, whereby 17.9 g of DAA-2 is obtained.

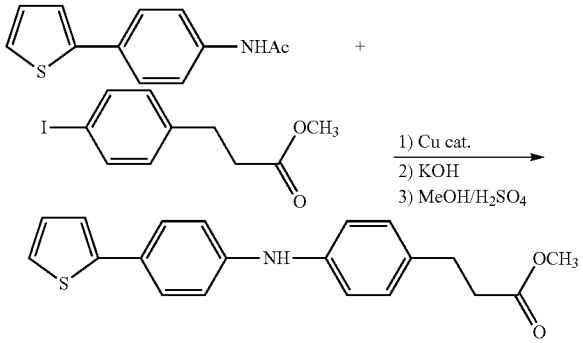

DAA-2

In the atmosphere of nitrogen, a mixed solution of 4-phenyl iodobenzene (4.0 g), DAA-2 (5.0 g), copper sulfate (II) pentahydrate (0.2 g), potassium carbonate (1.3 g), and tridecane (15 mL) is stirred at 210° C. for 15 hours.

After the end of the reaction, a solution obtained by dissolving potassium hydroxide (15.6 g) in ethylene glycol (300 mL) is added thereto, the resultant is heated to reflux in a nitrogen stream for 3.5 hours and is cooled to a room temperature (25° C.), the reaction solution is poured into 1 L of distilled water, the resultant is neutralized with hydrochloric acid, and crystals are precipitated. The crystals are captured by sucking filtration, are washed with water, and are then moved to a 1 L flask. Toluene (500 mL) is added thereto, the resultant is heated to reflux, and the water is removed by azeotropy, a methanol (300 mL) solution with a strong sulfuric acid (1.5 mL) is added thereto, and the resultant is heated to reflux in a nitrogen stream for 5 hours.

After the cooling, toluene is added to the resultant, then the resultant is filtrated with celite, and the product obtained by removing toluene is separated with a silica gel column chromatograph (hexane 2: toluene 1), whereby 3.0 g of TAA-5 is obtained.

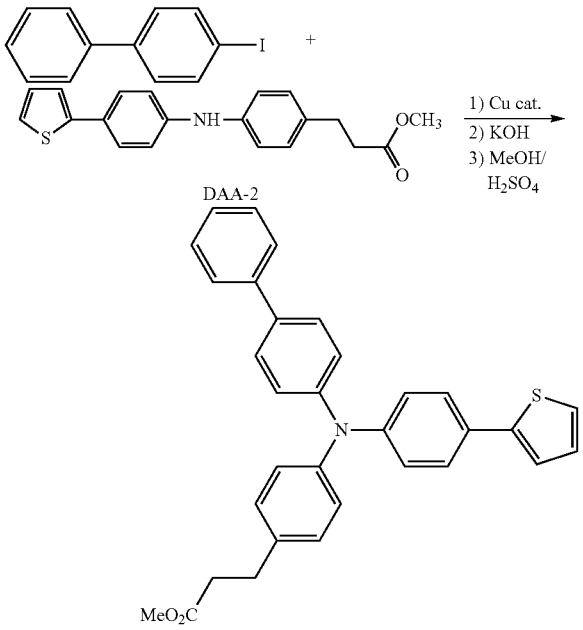

TAA-5

TAA-5 (3.0 g) is dissolved in N,N-dimethyl formamide (5 mL) and phosphorous oxychloride is dropped thereto. The resultant is stirred at a room temperature (25° C.) for 4 hours, N,N-dimethyl formamide anhydride (3 mL) is further added thereto, and the resultant is magnetically stirred for 13.5 hours. After the end of the reaction, water (100 mL) and ethylacetate (100 mL) are added thereto and stirred, the organic phase is separated, and the organic phase is washed with 50 mL of saturated saline and is dried with sodium sulfate. The crude product obtained by distilling the solvent is separated by the silica gel column chromatography (ethylacetate:hexane=1:4), whereby 2.5 g of a formylated product of TAA-5 is obtained.

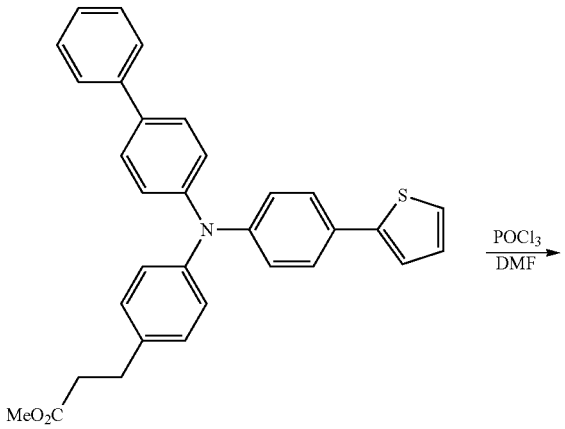

TAA-5

-continued

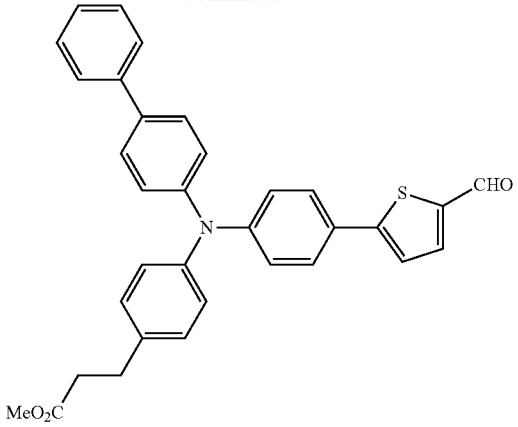

Formylated Product of TAA-5

The formylated product of TAA-5 (2.4 g) and rubeanic acid (0.37 g) are dissolved in mesitylene (5 mL) and the resultant is made to reflux for 30 hours. Solid obtained by distilling mesitylene under a depressurized condition is extracted with hexane by the use of a Soxhlet extractor (6 hours) to remove impurities. Then, the obtained crude crystals are separated by the silica gel column chromatography (toluene:ethylacetate=20:1), the resultant is re-crystallized in toluene, whereby 0.61 g of specific example compound (29) is obtained.

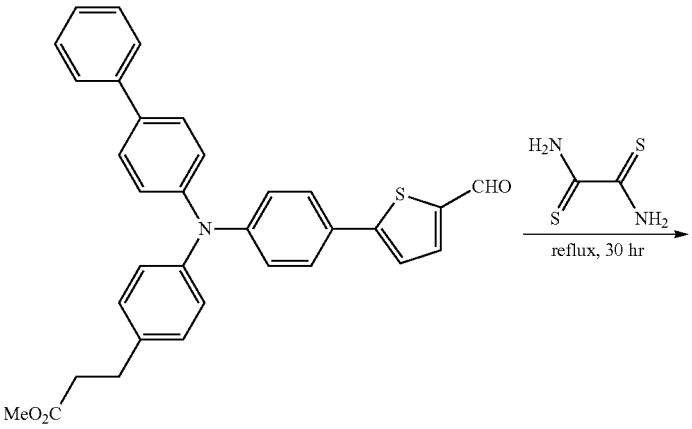

Formulated Product of TAA-5

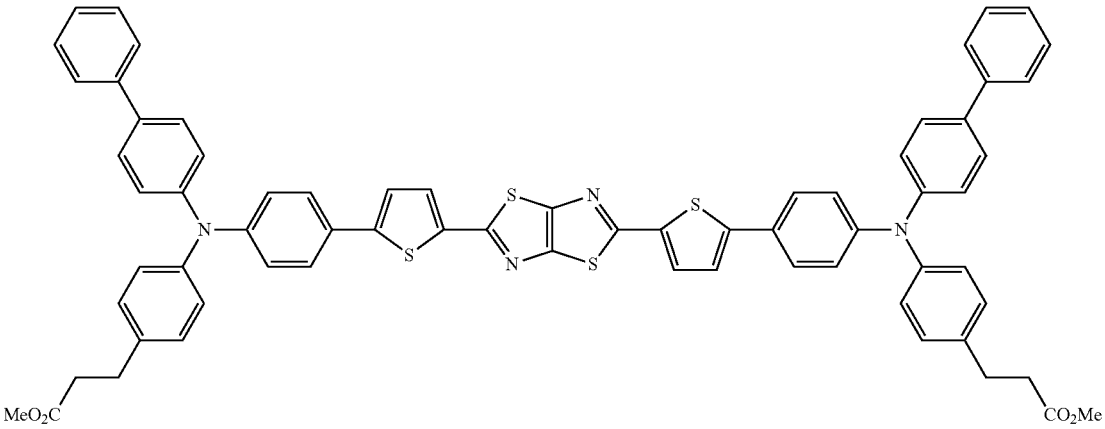

Specific Example Compound (29)

By the $^{1}$H-NMR spectrum measurement and the IR spectrum measurement, it is confirmed that the obtained compound is specific example compound (29).

(Production of Image Holding Member for Image Forming Apparatus)

Example 1

A solution including 10 parts by weight of a zirconium compound (Orgatics ZC540, made by Matsumoto Pharmaceutical Manufacture Co., Ltd.), 1 part by weight of a silane compound (A1110, made by Nippon Unicar Co., Ltd.), 40 parts by weight of i-propanol, and 20 parts by weight of butanol is applied onto an aluminum substrate by a dip coating method, and the resultant is heated and dried at 150° C. for 10 minutes, whereby the undercoating layer with a thickness of 0.6 μm is formed. A coating liquid obtained by mixing 1 part by weight of chlorogallium phthalocyanine crystals, which have strong diffraction peaks at bragg angles) (2θ±0.2°) of 7.4°, 16.6°, 25.5°, and 28.3° in an X-ray diffraction spectrum, with 1 part by weight of a polyvinyl butyral resin (S-REC BM-S, made by Sekisui Chemical Co., Ltd.) and 100 parts by weight of n-butyl acetate, and treating the resultant with glass beads and a paint shaker for 1 hour to disperse the mixture, is applied onto the undercoating layer by a dip coating method, and the resultant is heated and dried at 100° C. for 10 minutes, whereby the charge generation layer is formed.

Then, 2 parts by weight of specific example compound (4) and 3 parts by weight of a bisphenol (Z) polymer compound (with a viscosity-average molecular weight of 40,000) having a structure shown below are dissolved in 35 parts by weight of chlorobenzene by heating, and then the temperature is returned to the room temperature (25° C.). The resultant coating liquid is applied onto the charge generation layer by the dip coating method and the resultant is heated at 110° C. for 60 minutes, whereby the charge transport layer with a thickness of 20 μm is formed.

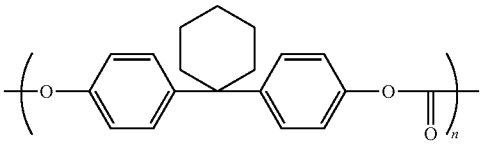

Bisphenol (Z) Polymer Compound

Examples 2 to 7

Image holding members for an image forming apparatus are produced, in the same way as Example 1, except that specific example polymer 6, specific example compound (23), specific example polymer 21, specific example compound (5), specific example compound (25), and specific example compound (29) are used instead of specific example compound (4) used in Example 1.

Example 8

An image holding member for an image forming apparatus is produced in the same way as Example 1, except that hydroxy gallium phthalocyanine crystals which have strong diffraction peaks at bragg angles (2θ±0.2°) of 7.5°, 9.9°, 12.5°, 16.3°, 18.6°, 25.1° and 28.3 in an X-ray diffraction spectrum is used instead of chlorogallium phthalocyanine crystals used in Example 1.

Comparative Example 1

An image holding member for an image forming apparatus is produced in the same way as described in Example 1, except that compound (X) having the following structure is used instead of specific example compound (4) used in Example 1.

(X)

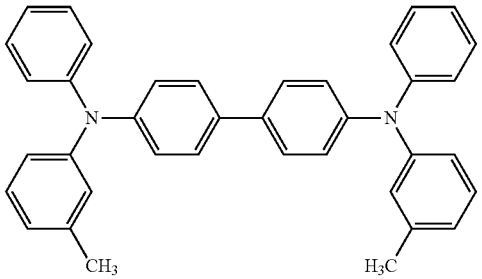

Comparative Example 2

An image holding member for an image forming apparatus is produced in the same way as described in Example 1, except that compound (XI) having the following structure is used instead of specific example compound (4) used in Example 1.

(XI)

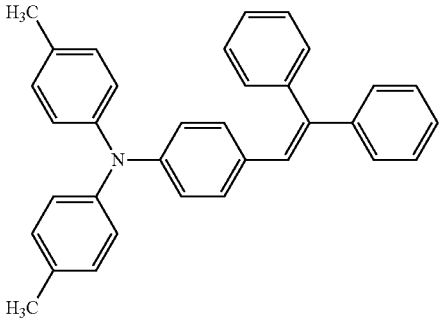

Comparative Example 3

An image holding member for an image forming apparatus is produced in the same way as described in Example 1, except that compound (VII) having the following structure is used instead of specific example compound (4) used in Example 1.

Compound (VII)

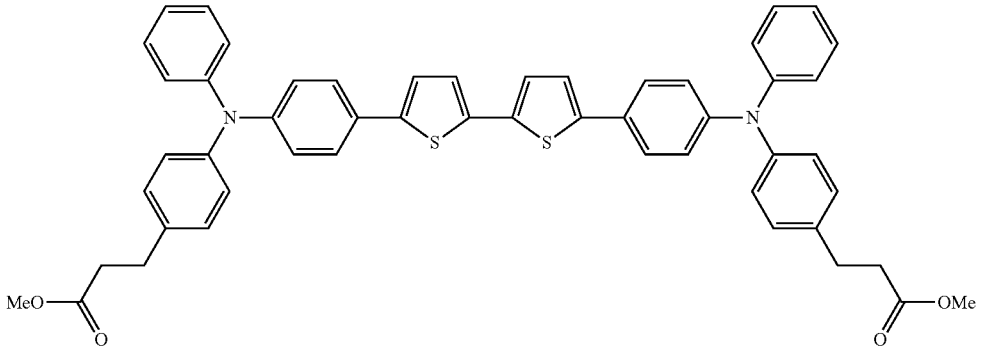

Comparative Example 4

An image holding member for an image forming apparatus is produced in the same way as described in Example 1, except that compound (VIII) (p=82) having the following structure is used instead of specific example compound (4) used in Example 1.

Then, image forming apparatuses are manufactured using the image holding members for an image forming apparatus obtained in the examples and the comparative examples. The elements mounted on a printer DOCUCENTER C6550I made by Fuji Xerox Co., Ltd. are used as elements other than the image holding member for an image forming apparatus.

Compound (VIII)

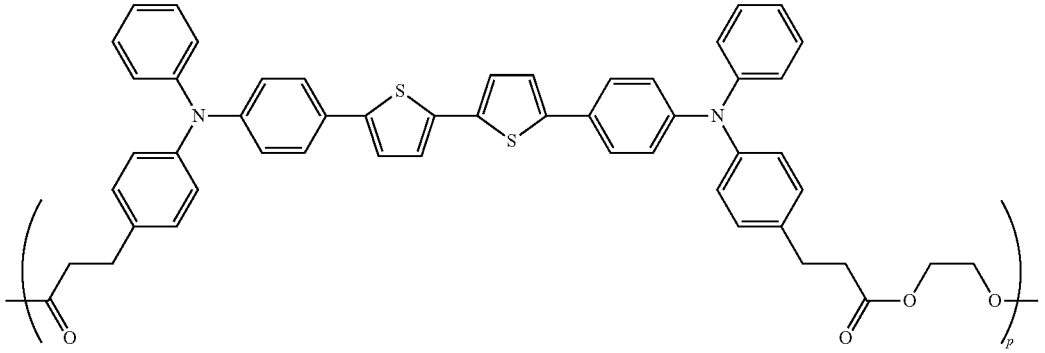

(Evaluations)

The electrophotographic characteristics of the image holding members for an image forming apparatus obtained in the examples and the comparative examples are inspected by the use of an electrostatic copying paper tester (ELECTROSTATIC ANALYZER EPA-8100, made by Kawaguchi Denki KK), by making corona discharge of −6 kV under the conditions of 20° C. and 40% RH to charge the photoreceptor, converting light of a tungsten lamp into monochromatic light of 800 nm with a monochrometer, and adjusting the power density to be 1 $\mu W/cm^2$ on the surface of the photoreceptor.

Just after the charging, the surface potential $V_0$(V) of the photoreceptor and a halving exposure dose E1/2 ($erg/cm^2$) with which the surface potential becomes $1/2 \times V_0$ (V) due to the irradiation of the photoreceptor surface with light are measured (initial characteristics). Thereafter, white light of 10 l× is applied for 1 second and then a residual potential VRP (V) remaining on the photoreceptor surface is measured (initial characteristic).

After the above charging, exposure (monochromatic light of 800 nm, halving exposure dose), and application of white light (10 l×) are repeated 1,000 times, $V_0$, E1/2, and VRP are measured, and the variations $\Delta V_0$, $\Delta$E1/2, and $\Delta$VRP are evaluated (stability and durability).

The image forming apparatuses are subjected to an image forming test (with an image density of 10% and 100% cyan) of 10,000 sheets under the conditions of 28° C. and 75% RH. As the test condition, processes of the cartridges are perfouned normally, but the toners in the cartridges other than the cyan toner are not used (supplied). After the test, the cleaning property of the toner (the contamination of the charging device or the deterioration in image quality due to the cleaning failure) and the image quality (process black 1 dot line oblique 45 degrees fine line reproducibility) are evaluated. The evaluation method and criteria of the cleaning property and the image quality are as follows and the results are shown in Table 1.

The cleaning property is evaluated with eyes and is evaluated based on the following evaluation criteria.

A: Excellent.

B: Striped image defect exists partially (10% or less of the total).

C: Striped image defect exists widely.

The image quality is determined with a magnifying glass and is evaluated on the basis of the following evaluation criteria.

A: Excellent

B: Partially defective (no actual problem)

C: Defective (fine line is not reproduced)

TABLE 1

| Example | Initial Characteristic (First) $V_0$ (V) | E½ (erg/cm²) | VRP (V) | Characteristic after 1000 repetitions $V_0$ (V) | E½ (erg/cm²) | VRP (V) | Stability ΔE½ (erg/cm²) | Durability ΔV0 (V) | ΔVRP (V) | Cleaning property | Image quality |
|---|---|---|---|---|---|---|---|---|---|---|---|
| Example 1 | −809 | 2.4 | −10 | −800 | 2.8 | −20 | 0.4 | 9 | 10 | A | B |
| Example 2 | −810 | 2.5 | −12 | −799 | 2.7 | −20 | 0.2 | 11 | 8 | A | A |
| Example 3 | −819 | 2.4 | −11 | −810 | 2.7 | −20 | 0.3 | 9 | 9 | A | A |
| Example 4 | −799 | 2.4 | −12 | −789 | 2.7 | −22 | 0.3 | 10 | 10 | A | A |
| Example 5 | −795 | 2.4 | −10 | −783 | 2.8 | −19 | 0.4 | 12 | 9 | A | A |
| Example 6 | −800 | 2.3 | −11 | −791 | 2.5 | −19 | 0.2 | 10 | 8 | A | A |
| Example 7 | −775 | 2.5 | −10 | −756 | 2.9 | −19 | 0.4 | 11 | 9 | A | A |
| Example 8 | −805 | 2.4 | −11 | −795 | 2.7 | −19 | 0.3 | 10 | 8 | A | B |
| Comparative Example 1 | −815 | 2.4 | −14 | −796 | 2.9 | −26 | 0.5 | 19 | 12 | B | C |
| Comparative Example 2 | −803 | 2.4 | −15 | −785 | 2.9 | −29 | 0.5 | 18 | 14 | B | C |
| Comparative Example 3 | −808 | 2.3 | −15 | −787 | 3.0 | −31 | 0.7 | 21 | 16 | B | C |
| Comparative Example 4 | −815 | 2.3 | −14 | −795 | 2.9 | −29 | 0.6 | 20 | 15 | B | C |

From the above results, it may be seen that the image holding member for an image forming apparatus obtained in the examples is lower in residual potential variation due to the repeated use than the comparative examples. It may be also seen that the image obtained by the image forming apparatus including the image holding member for an image forming apparatus is excellent in image quality.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image holding member for an image forming apparatus, comprising:

a substrate; and a photosensitive layer on the substrate, the photosensitive layer containing a charge generation material and a compound represented by the following Formula (I) or a compound represented by the following Formula (II-1)

Formula (I)

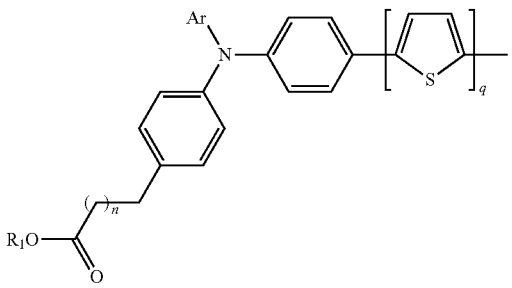

-continued

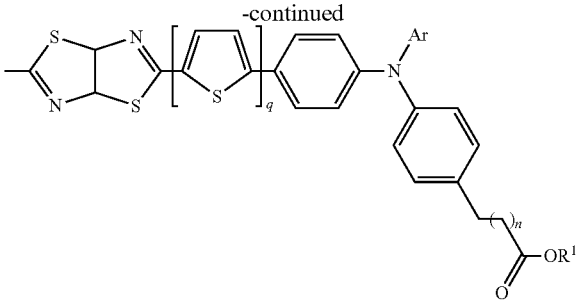

wherein in Formula (I), $R^1$'s each independently represent a substituted or unsubstituted, linear or branched alkyl group having from 1 to 8 carbon atoms; Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and n's each independently represent an integer of from 0 to 7, Formula (II-1)

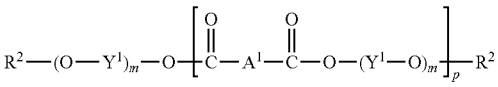

wherein in Formula (II-1), $Y^1$'s each independently represent a substituted or unsubstituted bivalent hydrocarbon group; $A^1$ represents a group represented by the following Formula (II-2); $R^2$'s each independently represent a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, a monovalent linear hydrocarbon group having from 1 to 6 carbon atoms, a monovalent branched hydrocarbon group having from 2 to 10 carbon atoms, or a hydrogen atom; m's each independently represent an integer of from 1 to 5; and p represents an integer of from 5 to 5,000, Formula (II-2)

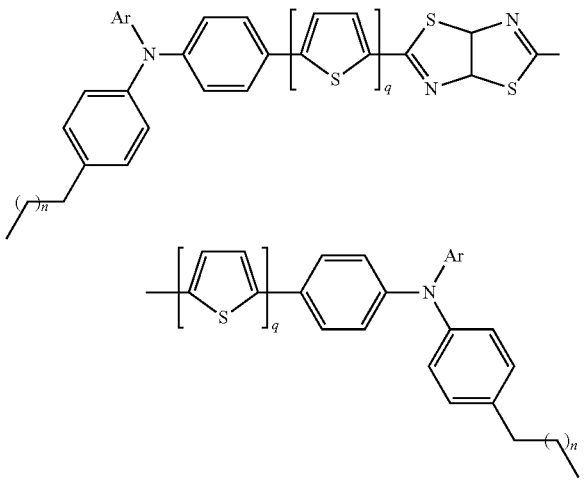

wherein in Formula (II-2), Ar represents a substituted or unsubstituted phenyl group, a substituted or unsubstituted monovalent polynuclear aromatic hydrocarbon group having from 2 to 10 aromatic rings, a substituted or unsubstituted monovalent condensed aromatic hydrocarbon group having from 2 to 10 aromatic rings, or a substituted or unsubstituted monovalent aromatic heterocyclic group; q represents 0 or 1; and n's each independently represent an integer of from 0 to 7.

2. The image holding member for an image forming apparatus according to claim 1, wherein the photosensitive layer contains the compound represented by Formula (I), wherein $R^1$'s in Formula (I) each independently represent a substituted or unsubstituted linear alkyl group having from 1 to 6 carbon atoms.

3. The image holding member for an image forming apparatus according to claim 1, wherein the photosensitive layer includes a charge transport layer containing the compound represented by Formula (I) or the compound represented by Formula (II-1).

4. The image holding member for an image forming apparatus according to claim 3, wherein a content of the compound represented by Formula (I) and the compound represented by Formula (II-1) in the charge transport layer is from about 5% by weight to about 70% by weight.

5. The image holding member for an image forming apparatus according to claim 1, wherein the photosensitive layer contains the compound represented by Formula (II-1), wherein $Y^1$'s in Formula (II-1) each independently represent an alkylene group, a (poly) oxy ethylene group, a (poly) oxy propylene group, an arylene group, a bivalent heterocyclic group, or a combination thereof.

6. The image holding member for an image forming apparatus according to claim 1, wherein the photosensitive layer contains the compound represented by Formula (I), wherein $R^1$'s in Formula (I) each independently represent a methyl group, an ethyl group, a propyl group, a n-butyl group, a t-butyl group, a n-hexyl group, or a n-octyl group.

7. The image holding member for an image forming apparatus according to claim 1, wherein the photosensitive layer contains the compound represented by Formula (I), wherein n's in Formula (I) each independently represent an integer of from 0 to 4.

8. The image holding member for an image forming apparatus according to claim 1, wherein the photosensitive layer contains the compound represented by Formula (II-1), wherein m's in Formula (II-1) each independently represent an integer of from 1 to 2.

9. The image holding member for an image forming apparatus according to claim 1, wherein the photosensitive layer contains the compound represented by Formula (II-1), wherein p in Formula (II-1) represents an integer of from 5 to 2,000.

10. The image holding member for an image forming apparatus according to claim 1, wherein the charge generation material comprises at least one selected from the group consisting of azo pigments, condensed aromatic pigments, perylene pigments, pyrrolopyrrole pigments, and phthalocyanine pigments.

11. A process cartridge comprising:

the image holding member for an image forming apparatus according to claim 1; and at least one selected from the group consisting of a charging device, an exposing device, a developing device, a transfer device, and a cleaning device.

12. The process cartridge according to claim 11, wherein the photosensitive layer contains the compound represented by Formula (I), wherein $R^1$'s in Formula (I) each independently represent a substituted or unsubstituted linear alkyl group having from 1 to 6 carbon atoms.

13. The process cartridge according to claim 11, wherein the photosensitive layer includes a charge transport layer containing the compound represented by Formula (I) or the compound represented by Formula (II-1).

14. The process cartridge according to claim 11, wherein the photosensitive layer contains the compound represented by Formula (II-1), wherein $Y^1$'s in Formula (II-1) each independently represent an alkylene group, a (poly) oxy ethylene group, a (poly) oxy propylene group, an arylene group, a bivalent heterocyclic group, or a combination thereof.

15. The process cartridge according to claim 11, wherein the photosensitive layer contains the compound represented by Formula (II-1), wherein p in Formula (II-1) represents an integer of from 5 to 2,000.

16. An image forming apparatus comprising:

the image holding member for an image forming apparatus according to claim 1;

a charging device that charges the image holding member;

an exposing device that forms an electrostatic latent image on a surface of the charged image holding member;

a developing device that develops the electrostatic latent image formed on the surface of the image holding member with a toner to form a toner image;

a transfer device that transfers the toner image formed on the surface of the image holding member onto a recording medium; and a cleaning device that cleans the image holding member.

17. The image forming apparatus according to claim 16, wherein the photosensitive layer contains the compound represented by Formula (I), wherein $R^1$'s in Formula (I) each independently represent a substituted or unsubstituted linear alkyl group having from 1 to 6 carbon atoms.

18. The image forming apparatus according to claim 16, wherein the photosensitive layer includes a charge transport layer containing the compound represented by Formula (I) or the compound represented by Formula (II-1).

19. The image forming apparatus according to claim 16, wherein the photosensitive layer contains the compound represented by Formula (II-1), wherein $Y^1$'s in Formula (II-1) each independently represent an alkylene group, a (poly) oxy ethylene group, a (poly) oxy propylene group, an arylene group, a bivalent heterocyclic group, or a combination thereof.

20. The image forming apparatus according to claim 16, wherein the photosensitive layer contains the compound represented by Formula (II-1), wherein p in Formula (II-1) represents an integer of from 5 to 2,000.

* * * * *